US009561658B2

(12) United States Patent
Danzuka et al.

(10) Patent No.: US 9,561,658 B2
(45) Date of Patent: Feb. 7, 2017

(54) PRINTING APPARATUS AND CONTROL METHOD

(71) Applicant: CANON KABUSHIKI KAISHA, Tokyo (JP)

(72) Inventors: Toshimitsu Danzuka, Tokyo (JP); Masaya Uetsuki, Yokohama (JP); Masataka Kato, Yokohama (JP); Tsuyoshi Ibe, Yokohama (JP); Asako Tomida, Kawasaki (JP); Hiroaki Komatsu, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/456,070

(22) Filed: Aug. 11, 2014

(65) Prior Publication Data

US 2015/0062231 A1 Mar. 5, 2015

(30) Foreign Application Priority Data

Aug. 28, 2013 (JP) ..... 2013-177240

(51) Int. Cl.
*B41J 29/393* (2006.01)
*B41J 2/165* (2006.01)
(Continued)

(52) U.S. Cl.
CPC ..... *B41J 2/16532* (2013.01); *B41J 2/16508* (2013.01); *B41J 2/175* (2013.01);
(Continued)

(58) Field of Classification Search
CPC ..... B41J 2/1652; B41J 2/16523; B41J 2/1721; B41J 2/17546
(Continued)

(56) References Cited

U.S. PATENT DOCUMENTS 6,338,539 B1 * 1/2002 Kobayashi ..... B41J 2/16532 347/108
6,447,095 B1 9/2002 Kanda et al.
(Continued)

FOREIGN PATENT DOCUMENTS

CN 1540457 A 10/2004
JP 2007-313829 A 6/2007

OTHER PUBLICATIONS

Office Action dated Oct. 26, 2015, in Chinese Patent Application No. 201410433003.4.

*Primary Examiner* — Jannelle M Lebron
*Assistant Examiner* — Jeremy Bishop
(74) *Attorney, Agent, or Firm* — Fitzpatrick, Cella, Harper & Scinto

(57) ABSTRACT

The present invention provided a printing apparatus including: an ink storage section; a detection unit detecting an ink remaining amount of the section; a printhead; an air communication section communicating with the section and air; a suction unit; and a control unit. When a predetermined transport-preparation condition regarding transport of the printing apparatus is satisfied, the control unit saves information about the ink remaining amount detected by the detection unit and controls the suction unit to drain ink in the air communication section through the printhead. When a predetermined start-up condition is satisfied, the control unit controls, based on the information, the suction unit to suck ink from the printhead.

34 Claims, 17 Drawing Sheets

(51) Int. Cl.
*B41J 2/175* (2006.01)
*B41J 29/38* (2006.01)

(52) U.S. Cl.
CPC ..... *B41J 2/17596* (2013.01); *B41J 29/38* (2013.01); *B41J 2002/17569* (2013.01)

(58) Field of Classification Search
USPC ..... 347/19, 22, 23, 29, 30, 36
See application file for complete search history.

(56) References Cited

U.S. PATENT DOCUMENTS 6,527,361 B1 3/2003 Gotoh et al.
6,557,969 B1 5/2003 Murakami et al.
6,644,777 B2 11/2003 Danzuka
6,702,421 B2 3/2004 Inui et al.
6,719,400 B2 4/2004 Inui et al.
6,752,485 B2 6/2004 Murakami et al.
6,854,826 B2 2/2005 Kanda et al.
6,984,018 B2 1/2006 Uetsuki et al.
7,031,012 B1 4/2006 Serizawa
7,527,348 B2 5/2009 Uetsuki et al.
7,918,531 B2 * 4/2011 Sugiyama ..... B41J 2/16532 347/23
8,794,737 B2 * 8/2014 Taira et al. ..... 347/23
2004/0233245 A1 * 11/2004 Matsumoto et al. ..... 347/19
2005/0185033 A1 8/2005 Miki
2005/0190226 A1 * 9/2005 Yoshikawa ..... B41J 2/1652 347/23
2008/0158273 A1 * 7/2008 Yoshikawa ..... B41J 2/16532 347/7
2010/0231641 A1 * 9/2010 Danzuka ..... 347/30
2011/0316906 A1 12/2011 Taira et al.
2012/0081423 A1 * 4/2012 Itogawa et al. ..... 347/7
2012/0127231 A1 * 5/2012 Nukui ..... 347/19
2012/0188304 A1 7/2012 Ibe et al.
2013/0076827 A1 * 3/2013 Kondo et al. ..... 347/19
2013/0286065 A1 * 10/2013 Uetsuki et al. ..... 347/7
2013/0286078 A1 10/2013 Kato et al.
2014/0218440 A1 8/2014 Komatsu et al.

* cited by examiner

PRINTING APPARATUS AND CONTROL METHOD

BACKGROUND OF THE INVENTION

Field of the Invention

The present invention relates to a printing apparatus.

Description of the Related Art

As a printing apparatus typified by an inkjet printing apparatus, a printing apparatus coping with printing media of relatively large sizes such as A1 size and A0 size has been proposed. A printing apparatus of this type includes an air communication section which makes an ink storage section, such as an ink tank storing ink, communicate with air. The printing apparatus is configured so that the ink liquid level in the air communication section becomes lower than the ink discharge face of a printhead in the direction of gravity. By this water head difference method, the inside of the printhead can be kept at a negative pressure. For this reason, if the printing apparatus is greatly tilted, ink sometimes leaks from the air communication section.

After installing a printing apparatus, if the printing apparatus needs to be transported to another place (also called secondary transport), it may be greatly tilted. There has been proposed a measure to drain the entire amount of ink in the printing apparatus before secondary transport (for example, Japanese Patent Laid-Open No. 2007-313829).

In general, an inkjet printing apparatus includes a suction device which sucks ink from a printhead in order to maintain the printhead performance. When draining ink in the printing apparatus before secondary transport, this suction device can be used to automate the work. However, ink drained by the suction device cannot be reused in general. If the entire amount of ink in the printing apparatus is drained, a large amount of ink is wasted. If air is mixed in an ink supply path when draining ink in the printing apparatus, ink is not discharged in use.

SUMMARY OF THE INVENTION

The present invention provides a technique capable of reducing waste of ink in secondary transport.

According to an aspect of the present invention, there is provided a printing apparatus comprising: an ink storage section configured to store ink; a detection unit configured to detect an ink remaining amount of the ink storage section; a printhead configured to discharge ink supplied from the ink storage section through an ink passage; an air communication section configured to communicate with the ink storage section and air; a suction unit configured to suck ink from the printhead; and a control unit configured to control the suction unit, wherein when a predetermined transport-preparation condition regarding transport of the printing apparatus is satisfied, the control unit is configured to save information about the ink remaining amount detected by the detection unit and is configured to control the suction unit to drain ink in the air communication section through the printhead, and when a predetermined start-up condition is satisfied, the control unit is configured to control, based on the information, the suction unit to suck ink from the printhead.

Further features of the present invention will become apparent from the following description of exemplary embodiments (with reference to the attached drawings).

DESCRIPTION OF THE EMBODIMENTS

Embodiments of the present invention will now be described. In this specification, the term "printing" not only includes the formation of significant information such as characters and graphics, but also broadly includes the formation of images, figures, patterns, and the like on a printing medium, or the process of the medium, regardless of whether they are significant or insignificant and whether they are so visualized as to be visually perceivable by humans.

Also, the term "printing medium" not only includes paper used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be extensively interpreted similar to the definition of "printing" described above. That is, "ink" includes a liquid which, when applied onto a printing medium, can form images, figures, patterns, and the like, can process the printing medium, or can process ink (for example, solidify or insolubilize a coloring agent contained in ink applied to the printing medium).

First Embodiment

Overall Arrangement

The first embodiment of the present invention will now be described with reference to the accompanying drawings. In the following embodiment, the present invention is applied to an inkjet printing apparatus. Here, an example in which a so-called thermal inkjet printhead is employed will be explained. However, a printhead of another method such as a piezoelectric method is also available.

Figure 1:
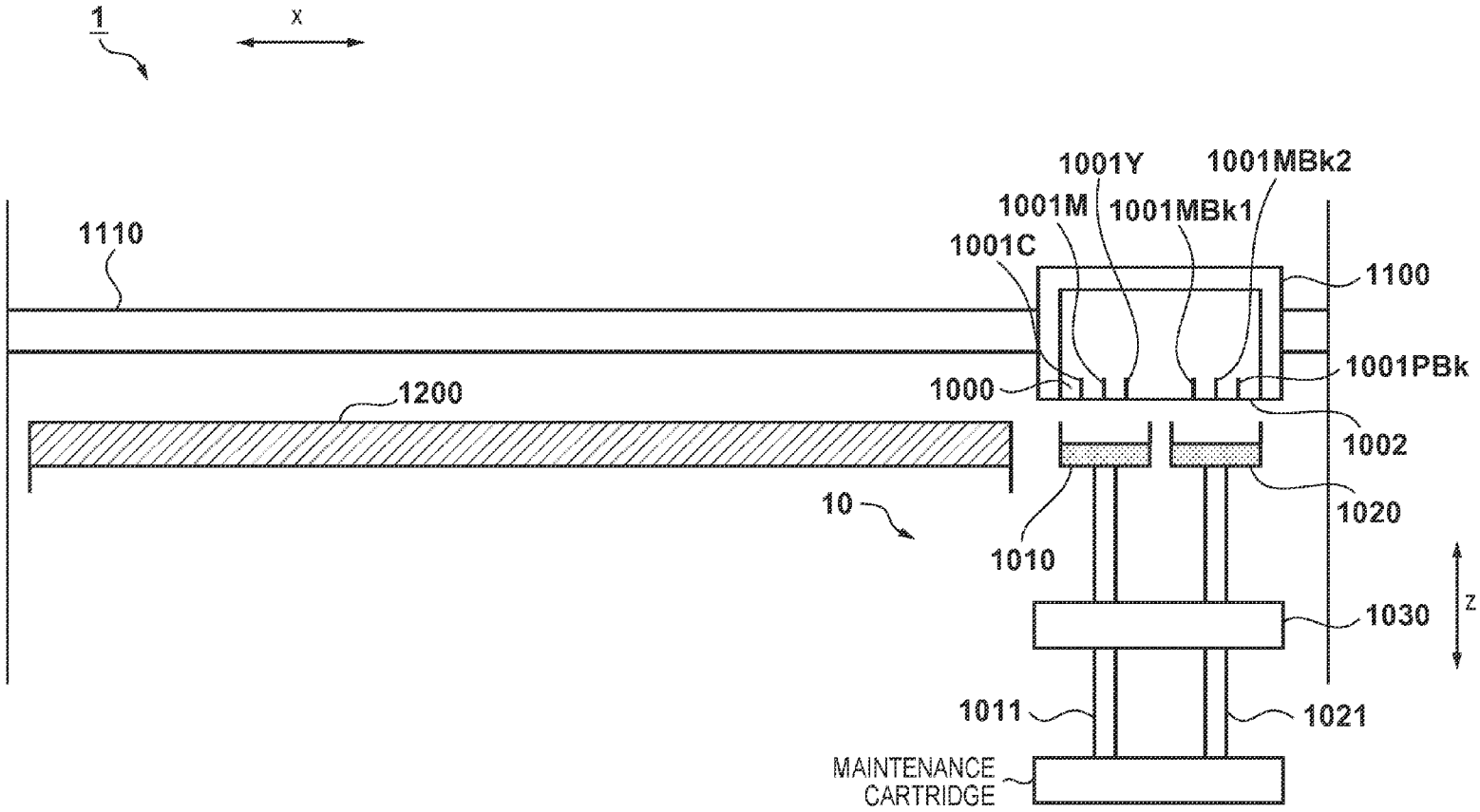
FIG. 1 is a schematic view showing a printing apparatus according to an embodiment of the present invention.

FIG. 1 is a schematic view showing a printing apparatus 1 according to the embodiment of the present invention. The printing apparatus 1 includes a printhead 1000 which prints an image by discharging ink. The printhead 1000 includes an ink discharge face 1002. In FIG. 1, an arrow Z indicates the vertical direction, and an arrow X indicates a direction perpendicular to the Z direction. The X direction is sometimes called a main scanning direction.

The embodiment assumes an arrangement in which the printhead 1000 can discharge a plurality of types of inks. On the ink discharge face 1002, ink orifice arrays 1001C, 1001M, 1001Y, 1001MBk1, 1001MBk2, and 1001PBk (to be generically referred to as ink orifice arrays 1001 hereinafter) are formed. Each ink orifice array 1001 includes a plurality of ink orifices (to be also referred to as nozzles) arranged in line. For example, 1,280 ink orifices are disposed on each line, and the interval between them is, for example, 1,200 dpi (dots/inch). The ink orifice array direction is a direction (to be also referred to as the Y direction or sub-scanning direction) perpendicular to the X and Z directions. Each ink orifice incorporates, for example, an electrothermal transducer. An electrical signal based on a driving signal is applied to the electrothermal transducer to generate a bubble in ink. By the pressure of the bubble, the ink can be discharged from the ink orifice.

In the embodiment, the ink orifice array 1001C discharges cyan ink. The ink orifice array 1001M discharges magenta ink. The ink orifice array 1001Y discharges yellow ink. The ink orifice arrays 1001MBk1 and 1001MBk2 discharge mat black ink. In the embodiment, the two arrays 1001MBk1 and 1001MBk2 are arranged as an orifice array for discharging mat black ink. The ink orifice array 1001PBk discharges photo black ink. Note that the type of ink is not limited to them.

The printhead 1000 is mounted on a carriage 1100. The carriage 1100 is guided by a guide shaft 1110, and can be reciprocated in the X direction by a driving mechanism (not shown). The driving mechanism is constituted by, for example, a carriage motor, and a belt transfer mechanism which transfers an output from the motor to the carriage 1100.

A printing medium is conveyed in the sub-scanning direction on a platen 1200 by a conveyance mechanism (not shown). The conveyance mechanism is constituted by, for example, a conveyance motor, and a pair of rollers which rotate in accordance with an output from the motor. For example, the printing medium is intermittently conveyed in the sub-scanning direction on the platen 1200. While the printing medium stops, the carriage 1100 is reciprocally scanned in the main scanning direction. During this reciprocal scanning, ink is discharged from the ink orifice of the printhead 1000 to the printing medium, printing an image. By repeating the intermittent conveyance of the printing medium and ink discharge during reciprocal scanning of the carriage 1100, printing of an image on one printing medium is completed.

The printing apparatus 1 also includes a suction unit 10. The suction unit 10 is one recovery mechanism for recovering or maintaining the performance of the printhead 1000. The performance of the printhead 1000 can be recovered by, for example, sucking highly viscous ink in the printhead 1000 by the suction unit 10. In the embodiment, the suction unit 10 includes caps 1010 and 1020, a suction pump 1030, and pump tubes 1011 and 1021.

The caps 1010 and 1020 are caps for suppressing evaporation of ink from the ink orifice. The caps 1010 and 1020 can be equipped with ink absorbers, respectively. The caps 1010 and 1020 are reciprocated in the Z direction between a capping position and a distant position by a known mechanism. The capping position is a position at which the cap covers the ink orifice. The distant position is a position spaced apart from the ink discharge face 1002. FIG. 1 shows a case in which the caps 1010 and 1020 are positioned at the distant position.

The insides of the caps 1010 and 1020 communicate with the pump tubes 1011 and 1021, respectively. The suction pump 1030 is, for example, a tube pump. The suction pump 1030 can be driven to suck the insides of the caps 1010 and 1020 to a negative pressure through the pump tubes 1011 and 1021. The ink sucked and drained by driving the suction pump 1030 is accommodated in a maintenance cartridge (not shown) through the pump tubes 1011 and 1021. The maintenance cartridge is configured to be, for example, freely detachable from the printing apparatus 1.

In the embodiment, the suction unit 10 can suck ink for each group of ink orifices. The cap 1010 caps a group of the ink orifice arrays 1001C, 1001M, and 1001Y. Ink can be sucked from these ink orifice arrays by the cap 1010. The cap 1020 caps a group of the ink orifice arrays 1001MBk1, 1001MBk2, and 1001PBk. Ink can be sucked from these ink orifice arrays by the cap 1020.

When ink is sucked from only the cap 1010, the cap 1010 is positioned at the capping position, and the cap 1020 is positioned at the distant position. Similarly, when ink is sucked from only the cap 1020, the cap 1020 is positioned at the capping position, and the cap 1010 is positioned at the distant position. As the method of individually sucking ink from the caps 1010 and 1020, another method can also be employed. For example, air communication valves are arranged in the caps 1010 and 1020, respectively. The air communication valve of a cap to be sucked is closed, and that of a cap not to be sucked is opened. Specific suction pumps may be arranged in the caps 1010 and 1020, respectively.

Figure 2:
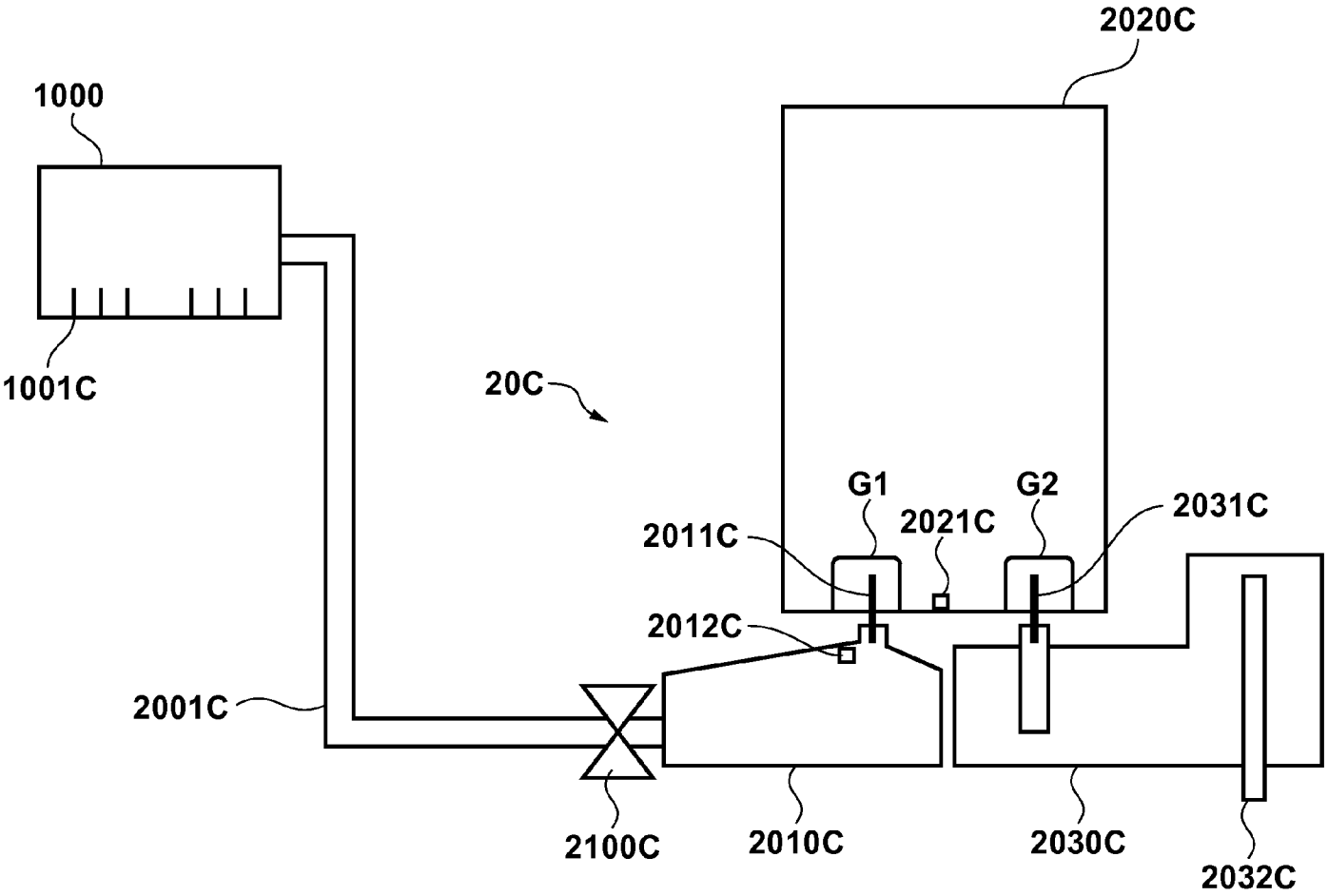
FIG. 2 is a schematic view showing an example of the arrangement of an ink supply system.

Next, the arrangement of an ink supply system for the printhead 1000 will be explained with reference to FIG. 2. FIG. 2 shows the arrangement of an ink supply system for the ink orifice array 1001C. That is, FIG. 2 shows the arrangement of an ink supply system for cyan ink.

The printing apparatus 1 includes, as the ink supply system for cyan ink, an ink storage section 20C, air communication section 2030C, opening/closing valve 2100C, and supply tube 2001C. The ink storage section 20C can store cyan ink, and is constituted by two members, that is, a sub-tank 2010C and ink tank 2020C in the embodiment. The sub-tank 2010C is fixed to the printing apparatus 1, and the ink tank 2020C is detachable from the printing apparatus 1.

The supply tube 2001C communicates with the sub-tank 2010C to constitute an ink passage between the sub-tank 2010C and the printhead 1000. The printhead 1000 receives cyan ink from the ink storage section 20C through the supply tube 2001C.

A hollow feeding needle 2011C is arranged above the sub-tank 2010C in the direction of gravity. In a state in which the ink tank 2020C is attached to the printing apparatus 1, the feeding needle 2011C extends through a rubber plug G1 arranged in the ink tank 2020C. When the feeding needle 2011C extends through the rubber plug G1, the sub-tank 2010C and ink tank 2020C communicate with each other.

The air communication section 2030C includes a hollow feeding needle 2031C above in the direction of gravity. In a state in which the ink tank 2020C is attached to the printing apparatus 1, the feeding needle 2031C extends through a rubber plug G2 arranged in the ink tank 2020C. When the feeding needle 2031C extends through the rubber plug G2, the ink tank 2020C and air communication section 2030C communicate with each other. The inside of the air communication section 2030C and the feeding needle 2031C communicate with each other at a position near the bottom of the air communication section 2030C.

The air communication section 2030C has an air communication port 2032C. When the feeding needle 2031C extends through the rubber plug G2, cyan ink in the ink tank 2020C can communicate with air. The inside of the air communication section 2030C and the air communication port 2032C communicate with each other at a position near the top of the air communication section 2030C.

In some cases, ink flows from the ink tank 2020C into the air communication section 2030C through the feeding needle 2031C. The ink liquid level in the air communication section 2030C is designed to be lower than the ink discharge face 1002 of the printhead 1000 in the direction of gravity. By a so-called water head difference, the inside of the printhead 1000 is kept at a negative pressure. It is also configured not to damage a meniscus formed in the ink orifice by the water head difference.

The ink liquid level in the sub-tank 2010C in a state in which the ink tank 2020C is separated from the printing apparatus 1 is configured to be almost flush with the ink liquid level in the air communication section 2030C in the direction of gravity. Therefore, the ink tank 2020C can be replaced even during the printing operation.

Figure 3A:
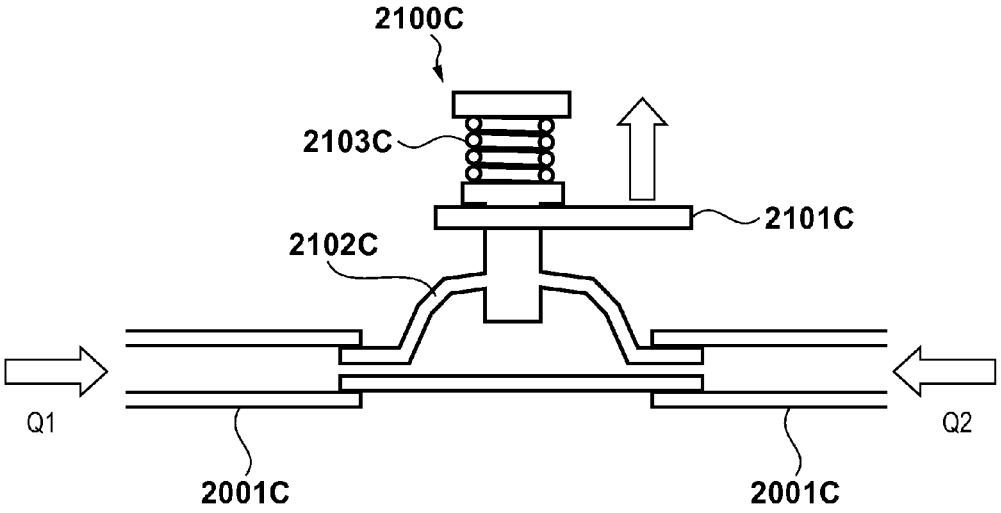
FIGS. 3A and 3B are schematic views showing an example of the structure of an opening/closing valve.
Figure 3B:
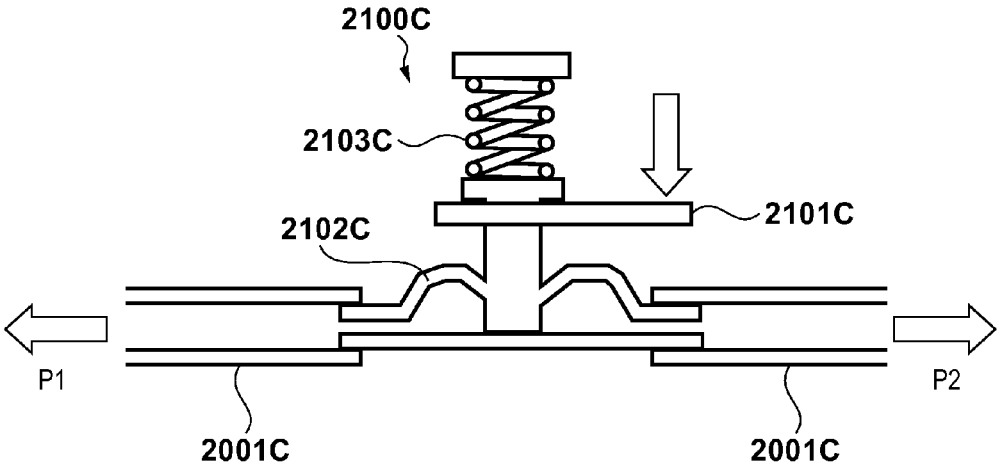

The opening/closing valve 2100C is inserted in the supply tube 2001C to be adjacent to the sub-tank 2010C. The opening/closing valve 2100C opens/closes the ink passage formed by the supply tube 2001C. The opening/closing valve 2100C also has a charging function of moving ink from the inside of the ink tank 2020C to the inside of the sub-tank 2010C by the opening/closing operation. Movement of ink to the sub-tank 2010C is sometimes called charging of the sub-tank. FIGS. 3A and 3B are schematic views showing an example of the structure of the opening/closing valve 2100C. FIG. 3A shows an open state, and FIG. 3B shows a closed state.

In FIG. 3A, a main body 2102C of the valve is pulled up in this drawing by a lever 2101C to form the open state in which ink is supplied. In FIG. 3B, the lever 2101C moves down in this drawing to move down the main body 2102C of the valve and close the ink channel. The opening/closing operation of the opening/closing valve 2100C is performed by moving up and down the lever 2101C by a driving mechanism (not shown). Note that a spring 2103C is a push-down spring which pushes down the lever 2101C.

When the opening/closing valve 2100C having this structure shifts from the closed state (FIG. 3B) to the open state (FIG. 3A), the internal volume of the main body 2102C of the valve increases. By this volume change, ink is drawn from the printhead 1000 and sub-tank 2010C to the main body 2102C of the valve, as indicated by arrows Q1 and Q2 in FIG. 3A. By the ink drawing action, the internal pressure of the sub-tank 2010C is reduced. As a result, the ink in the ink tank 2020C moves into the sub-tank 2010C.

When ink exists in the air communication section 2030C in this drawing operation, it moves into the ink tank 2020C. When no ink exists in the air communication section 2030C, air moves into the ink tank 2020C through the air communication section 2030C. In either case, air flows into the air communication section 2030C through the air communication port 2032C.

In this drawing operation, ink is drawn even from the printhead 1000 (see the arrow Q1). By arranging a flexible member in the printhead 1000 for each ink orifice array 1001, the pressure reduction by the ink drawing action can be canceled by the flexure of the flexible member.

To the contrary, when the opening/closing valve 2100C shifts from the open state (FIG. 3A) to the closed state (FIG. 3B), the internal volume of the main body 2102C of the valve decreases. By this volume change, ink discharged from the inside of the main body 2102C of the valve moves to the printhead 1000 and sub-tank 2010C (see arrows P1 and P2 in FIG. 3B). By the draining action, the inside of the sub-tank 2010C is pressurized.

When the inside of the sub-tank 2010C is pressurized, if it is filled with ink, the ink moves into the ink tank 2020C. If air exists in the sub-tank 2010C, it moves into the ink tank 2020C. In the draining operation, ink in the ink tank 2020C moves to the air communication section 2030C, and the air flows out from the air communication port 2032C.

In the draining operation, the ink moves even to the printhead 1000 (see the arrow P1 in FIG. 3B). By arranging the above-mentioned flexible member in the printhead 1000 for each ink orifice array, the pressurization by the draining action can be canceled by the flexure of the flexible member.

As described above, when air exists in the sub-tank 2010C, gas-liquid exchange is performed between the sub-tank 2010C and the ink tank 2020C by repeating the opening/closing operation of the opening/closing valve 2100C. As a result, the ink in the ink tank 2020C moves into the sub-tank 2010C. That is, the inside of the sub-tank 2010C can be charged with ink by repetitively performing the opening/closing operation of the opening/closing valve 2100C when the sub-tank 2010C is not full.

Referring back to FIG. 2, the sub-tank 2010C includes a sensor 2012C capable of detecting an ink remaining amount in the sub-tank 2010C. In the embodiment, the sensor 2012C is arranged near the feeding needle 2011C to detect whether the sub-tank 2010C is full. As the sensor 2012C, a known remaining amount detection sensor is usable. For example, a sensor which detects a liquid level by using an optical sensor, or a sensor which detects a liquid level based on the presence/absence of energization between two electrodes is available.

The ink tank 2020C also includes a sensor 2021C capable of detecting an ink remaining amount in the ink tank 2020C. In the embodiment, the sensor 2021C is a near end sensor which is arranged near the bottom of the ink tank 2020C to detect that the ink remaining amount in the ink tank 2020C is running short. As the sensor 2021C, a known remaining amount detection sensor is usable. For example, a sensor which detects a liquid level by using an optical sensor, or a sensor which detects a liquid level based on the presence/absence of energization between two electrodes is available.

In the embodiment, the ink remaining amounts in the sub-tank 2010C and ink tank 2020C are detected by so-called dot counters, in addition to the sensors 2012C and 2021C. The dot counter can be implemented by a control unit (to be described later). The dot counter is a counter which counts the amount of ink drained from the ink orifice array 1001C. The ink drained from the ink orifice array 1001C includes ink discharged from the ink orifice, and sucked/drained ink. The dot counter counts a value obtained by multiplying the number of discharge ink droplets by the volume of each droplet, and a suction draining amount.

The ink tank 2020C can also be equipped with a memory which stores the ink remaining amount of the ink tank 2020C. This memory facilitates management of the ink remaining amount before and after the ink tank 2020C is detached. Whether the ink tank 2020C is attached to the printing apparatus 1 can also be detected by accessing this memory by the control unit (to be described later).

An example of the arrangement of the ink supply system for cyan ink has been described above. However, similar ink supply systems are arranged even for the remaining ink types (magenta, yellow, mat black, and photo black).

In the following description, the building components of the ink supply systems for the respective ink types will be generically called ink storage sections 20, sub-tanks 2010, ink tanks 2020, air communication sections 2030, opening/closing valves 2100, and supply tubes 2001. When an ink type is designated, a sign (C, M, Y, MBk, or PBk) representing the ink type is added to these building components. For example, the ink storage section 20 for magenta will be referred to as the ink storage section 20M.

In the embodiment, the two ink orifice arrays are arranged for mat black ink, as described above. Thus, the ink supply system includes two supply tubes 2001MBk and two opening/closing valves 2100MBk. The number of ink storage sections 20MBk is one, and the two supply tubes 2001MBk communicate with the common sub-tank 2010MBk.

One of the two supply tubes 2001MBk and one of the two opening/closing valves 2100MBk are for the ink orifice array 1001MBk1. One supply tube 2001MBk and one opening/closing valve 2100MBk are sometimes called the supply tube 2001MBk1 and opening/closing valve 2100MBk1. The other one of the two supply tubes 2001MBk and the other one of the two opening/closing valves 2100MBk are for the ink orifice array 1001MBk2. Thus, the other supply tube 2001MBk and the other opening/closing valve 2100MBk are sometimes called the supply tube 2001MBk2 and opening/closing valve 2100MBk2.

<Control Unit>

Figure 4:
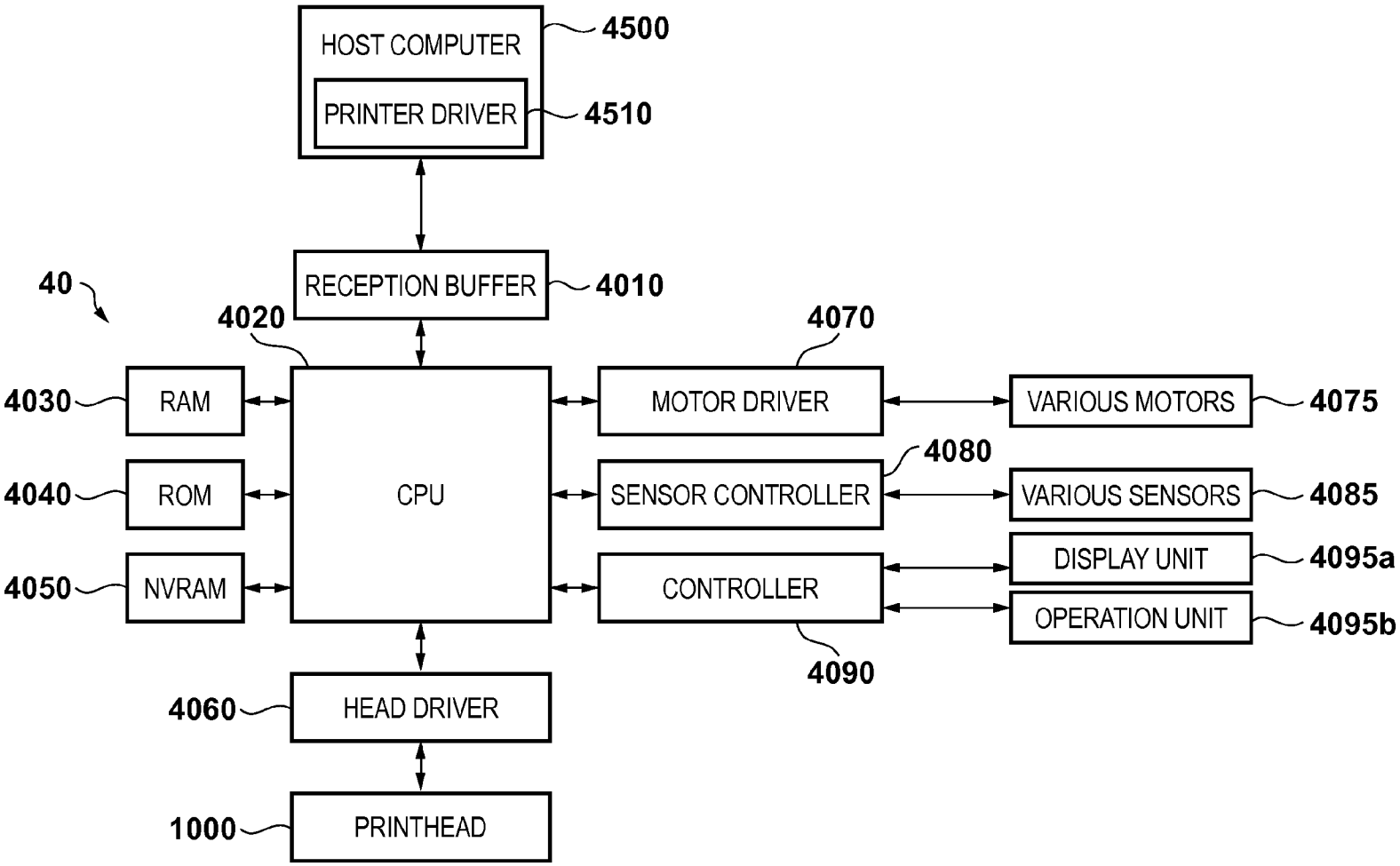
FIG. 4 is a block diagram showing the control system of the printing apparatus in FIG. 1.

FIG. 4 is a block diagram showing the control system of the printing apparatus 1. The printing apparatus 1 includes a control unit 40. The control unit 40 includes a CPU 4020. The CPU 4020 controls the overall printing apparatus 1.

A ROM 4040 stores programs, permanent data, and the like necessary for various control operations of the printing apparatus 1. The CPU 4020 executes a program stored in the ROM 4040. An NVRAM 4050 is a nonvolatile memory for saving information which should be stored even when the printing apparatus 1 is turned off. A RAM 4030 is a memory which provides the work area of the CPU 4020. A reception buffer 4010 holds print data and the like transmitted from a host computer 4500 to the printing apparatus 1. The print data and the like held in the reception buffer 4010 are transferred to the RAM 4030 and temporarily stored under the management of the CPU 4020.

The host computer 4500 is connected to the printing apparatus 1 via a USB interface or the like. A printer driver 4510 is stored in the form of software in the host computer 4500. In accordance with a print instruction from the user, the printer driver 4510 generates print data from image data of a document, photograph, or the like the user wants, and transmits the print data to the printing apparatus 1.

A head driver 4060 is a driver which drives the printhead 1000. A motor driver 4070 drives various motors 4075. The motors 4075 include a carriage motor, a conveyance motor, a motor for a driving mechanism for moving up and down the caps 1010 and 1020, and a motor for opening/closing the opening/closing valve 2100. A sensor controller 4080 controls various sensors 4085. The control of the sensors 4085 includes acquisition of the detection results of the sensors 4085. The sensors 4085 include the sensors 2012 and 2021, and a position detection sensor for the carriage 1100. The controller 4080 controls a display unit 4095*a* and operation unit 4095*b* of the printing apparatus 1.

[Control Example]

An example of control to be executed by the CPU 4020 will be described. Processing when secondarily transporting the printing apparatus 1 will be explained. Processing to be executed by the CPU 4020 is roughly divided into processing before secondary transport (pre-transport preparation processing), and post-transport processing (post-transport start-up processing). The embodiment assumes that secondary transport is performed in a state in which the ink tank 2020 is detached from the printing apparatus 1. This is because, if the ink tank 2020 is damaged during transport, a large amount of ink may leak.

In pre-transport preparation processing, ink in the air communication section 2030 is drained to prevent leakage of ink from the air communication section 2030 at the time of secondary transport. It is not always necessary to completely drain ink in the air communication section 2030. The draining amount can be set on the premise of a range in which the printing apparatus 1 is tilted at the time of transport.

Ink in the air communication section 2030 is drained by the suction unit 10 through the printhead 1000. By using the suction unit 10, draining of ink can be automated. However, the drained ink becomes waste ink. For this reason, if the entire amount of ink in the ink supply system is drained, the waste ink amount becomes large.

In the embodiment, ink which is wasted in secondary transport is reduced by minimizing ink to be drained. Ink remaining in the ink supply system is used even after transport. However, air may be mixed in the ink supply system.

In post-transport start-up processing, for an ink supply system for which it is determined that air may be mixed, the entire amount of remaining ink in the supply tube 2001 and printhead 1000 is replaced. For an ink supply system for which it is determined that air is not mixed, the entire amount or almost entire amount of remaining ink is used. Mixing of air is determined in pre-transport preparation processing. In pre-transport preparation processing, information about the ink remaining amount of the ink storage section 20 is saved. In post-transport start-up processing, an ink supply system in which air may be mixed is discriminated by referring to the saved information. A detailed control example will be explained below.

Figure 5:
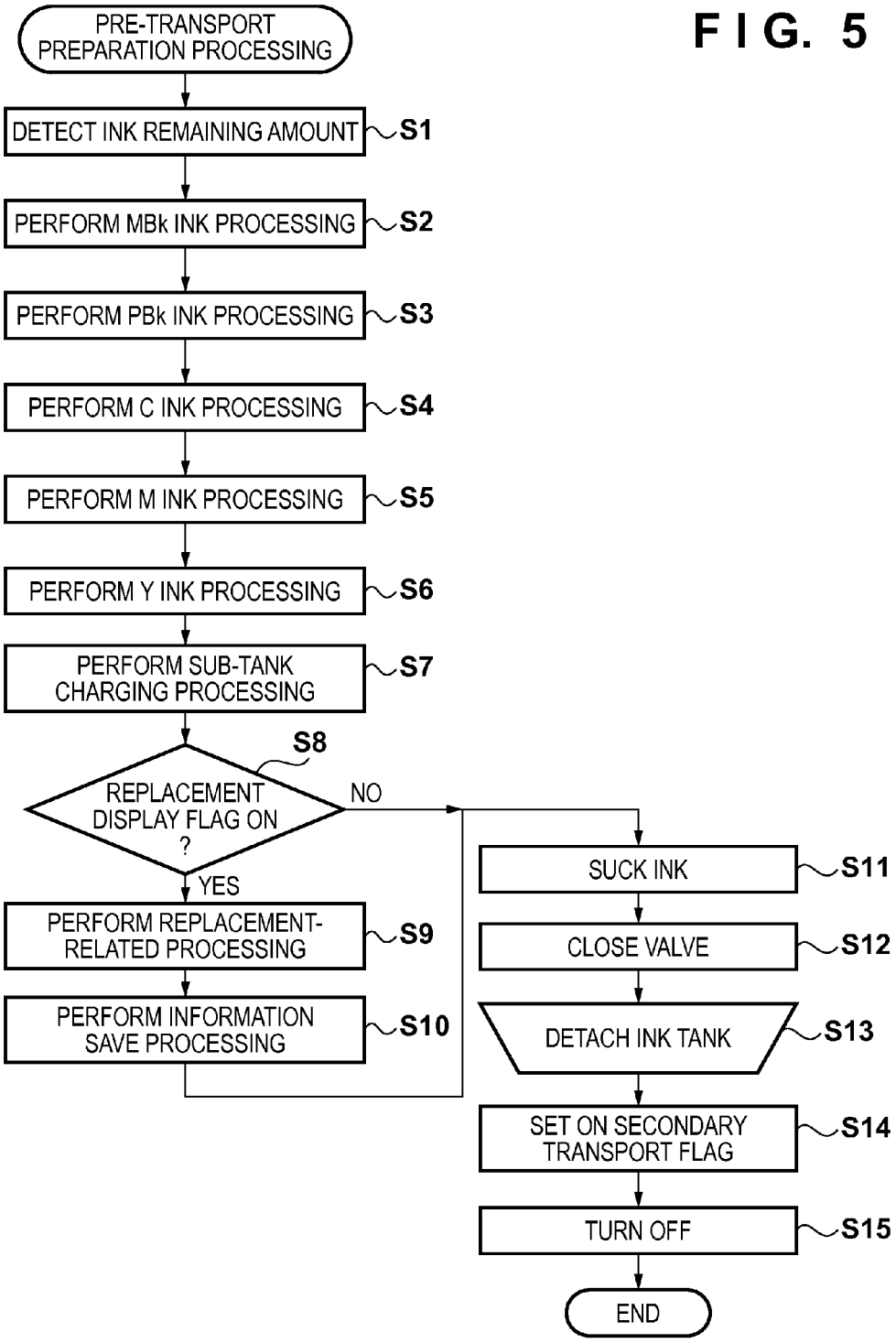
FIG. 5 is a flowchart showing an example of pre-transport preparation processing.

FIG. 5 is a flowchart showing an example of pre-transport preparation processing. The pre-transport preparation processing is executed when a predetermined transport-preparation condition regarding transport of the printing apparatus 1 is satisfied. The case in which the transport-preparation condition is satisfied is, for example, a case in which the user performs a predetermined operation on the operation unit 4095*b*. Another example is that the user performs a predetermined operation on the host computer 4500 to issue a processing start instruction from the host computer 4500 to the printing apparatus 1.

In step S1, the ink remaining amount of the ink storage section 20 is detected. The ink remaining amount in the sub-tank 2010 is detected by the sensor 2012 and dot counter. The ink remaining amounts of the sub-tanks 2010 for the respective, cyan, magenta, yellow, mat black, and photo black inks are represented by SC, SM, SY, SMBk, and SPBk, and generically referred to as S.

The ink remaining amount in the ink tank 2020 is detected by the sensor 2021 and dot counter. The ink remaining amounts in the ink tanks 2020 for the respective, cyan, magenta, yellow, mat black, and photo black inks are represented by IC, IM, IY, IMBk, and IPBk, and generically referred to as I.

Then, a total remaining amount TO is calculated for each ink type. TO=S+I. The total remaining amounts of the respective, cyan, magenta, yellow, mat black, and photo black inks are represented by TOC, TOM, TOY, TOMBk, and TOPBk, respectively.

Figure 6:
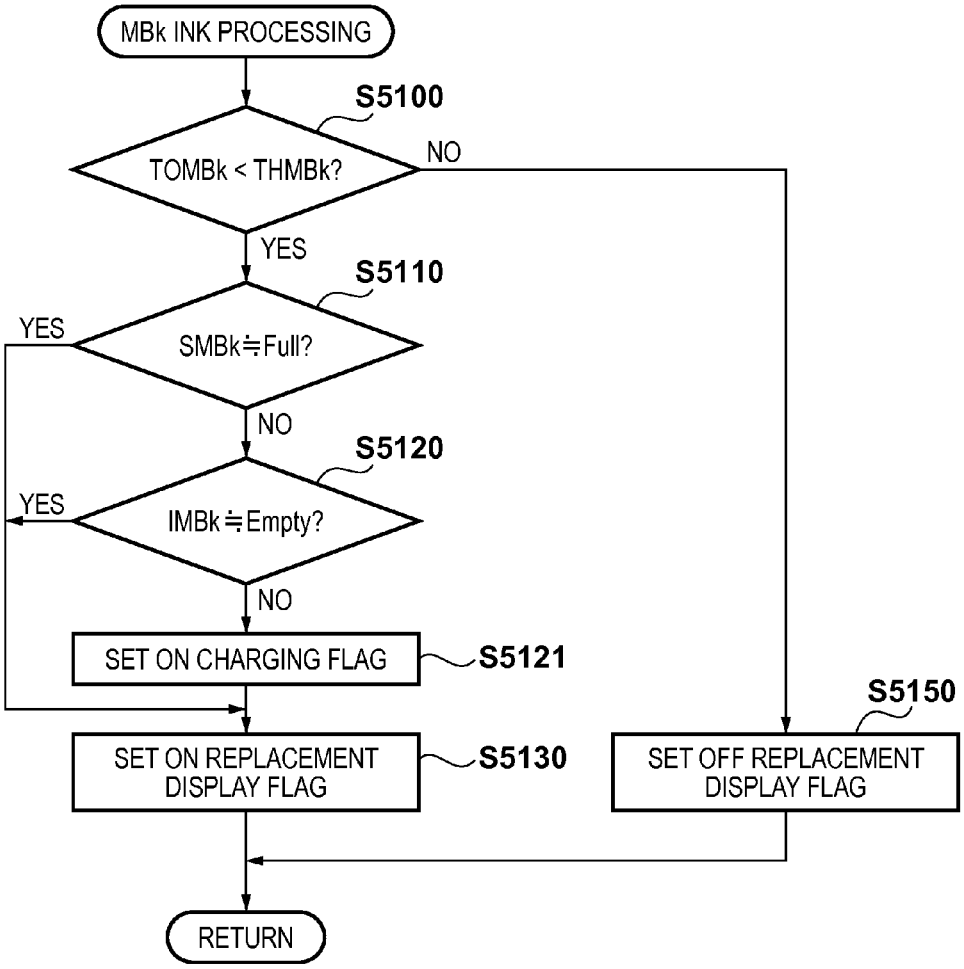
FIG. 6 is a flowchart showing MBk ink processing.

In step S2, MBk ink processing is performed. FIG. 6 is a flowchart showing the contents. In step S5100, comparative determination between TOMBk and a preset threshold THMBk for the mat black ink supply system is performed. Note that the concrete value of THMBk in the embodiment is assumed to be 21 ml, but is not limited to this. This threshold is set for each ink type.

If the determination result is YES in step S5100, that is, TOMBk<THMBk, the process advances to step S5110. If the determination result is NO, that is, TOMBk≥THMBk, the process advances to step S5150. In step S5150, a replacement display flag for the ink tank 2020MBk is set off, and processing of one unit ends. The replacement display flag is a flag representing whether to perform processing of prompting the user to replace an ink tank of this ink type. The replacement display flag is set for each ink type by using, for example, a predetermined area of the RAM 4030.

In step S5110, it is determined whether the inside of the sub-tank 2010MBk is almost full of mat black ink. This determination uses the detection result of the sensor 2012MBk. The capacity of the sub-tank 2010MBk in the embodiment is assumed to be about 18 ml, but is not limited to this.

If the determination result in step S5110 is YES, that is, the sub-tank 2010MBk is full, the process advances to step S5130. If the determination result is NO, the process advances to step S5120.

In step S5130, the replacement display flag for the ink tank 2020MBk is set on. At this time, since the sub-tank 2010MBk has already been full, a sub-tank charging flag (to be described later) is not set on. After the replacement display flag for the ink tank 2020MBk is set on, processing of one unit ends.

In step S5120, it is determined whether the ink tank 2020MBk is almost empty. This determination uses the detection result of the sensor 2021MBk. If the determination result in step S5120 is YES, that is, the ink remaining amount in the ink tank 2020MBk is almost empty, the process advances to step S5130. Even in this case, the sub-tank charging flag (to be described later) is not set on. This is because the ink remaining amount in the ink tank 2020MBk is almost empty, and even if the sub-tank charging operation is performed, ink capable of charging the inside of the sub-tank 2010MBk hardly remains.

If the determination result in step S5120 is NO, that is, the ink tank 2020MBk is not almost empty, the process advances to step S5121 to set on the sub-tank charging flag for the sub-tank 2010MBk. The sub-tank charging flag is a flag representing whether to perform a charging operation for the sub-tank of this ink type. The sub-tank charging flag is set for each ink type by using, for example, a predetermined area of the RAM 4030. The process then advances to step S5130 to set on the replacement display flag for the ink tank 2020MBk.

By steps S5100 to S5130 described above, if the ink tank 2020MBk should be replaced (remaining amount is small), the replacement display flag is set on. If the sub-tank 2010MBk should be charged with ink and can be charged, the sub-tank charging flag is set on.

Figure 7A:
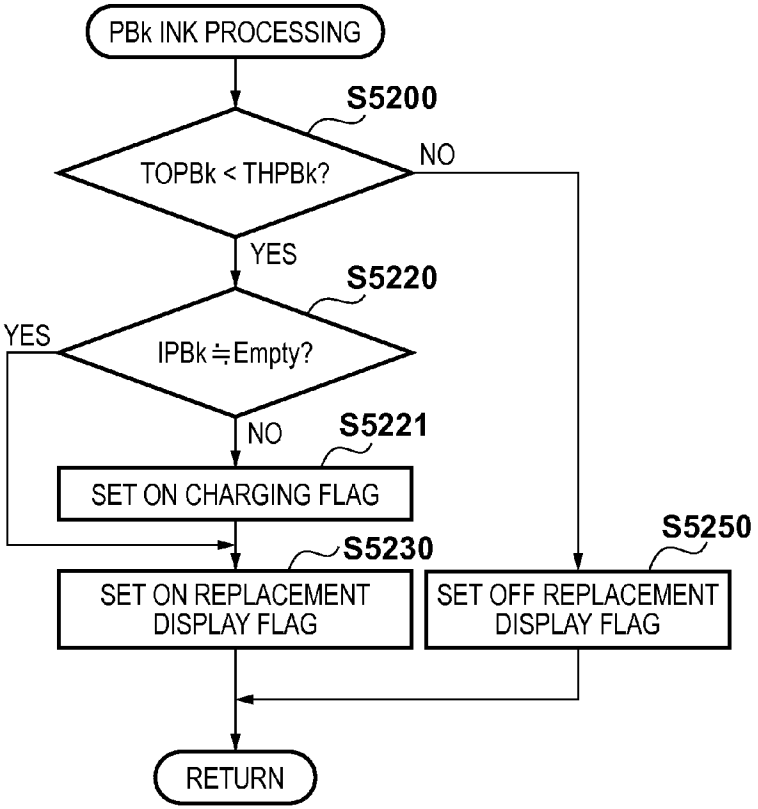
FIG. 7A is a flowchart showing PBk ink processing.

Referring back to FIG. 5, PBk ink processing is performed in step S3. This processing is almost the same as MBk ink processing in step S2, and is processing of setting the charging flag and replacement display flag. FIG. 7A is a flowchart showing the contents.

In step S5200, comparative determination between TOPBk and a preset threshold THPBk for the photo black ink supply system is performed. Note that the concrete value of THPBk in the embodiment is assumed to be 11 ml, which is almost half of THMBk. The reason of this will be described later.

If the determination result is YES in step S5200, that is, TOPBk<THPBk, the process advances to step S5220. In step S5220, it is determined based on the detection result of the sensor 2021PBk whether the ink tank 2020PBk is almost empty. Similar to the capacity of the sub-tank 2010MBk, the capacity of the sub-tank 2010PBk in the embodiment is assumed to be about 18 ml, but is not limited to this. If the determination result in step S5200 is YES, that is, TOPBk<THPBk (11 ml), the inside of the sub-tank 2010PBk is not full of photo black ink.

If the determination result in step S5220 is YES, that is, the ink tank 2020PBk is almost empty, the process advances to step S5230 to set on the replacement display flag for the ink tank 2020PBk. Even at this time, the ink remaining amount in the ink tank 2020PBk is almost empty, and even if the sub-tank charging operation is performed, ink capable of charging the inside of the sub-tank 2010PBk hardly remains. Thus, the sub-tank charging flag is not set on. After the replacement display flag for the ink tank 2020PBk is set on, processing of one unit ends.

If the determination result in step S5220 is NO, that is, the ink tank 2020PBk is not almost empty, the process advances to step S5221. In step S5221, the sub-tank charging flag for the sub-tank 2010PBk is set on. Thereafter, the process advances to step S5230.

By steps S5200 to S5230 described above, if the ink tank 2020PBk should be replaced, the replacement display flag is set on. If the sub-tank 2010PBk should be charged with ink, the sub-tank charging flag for photo black is set on.

Referring back to step S5200, if the determination result in step S5200 is NO, that is, TOPBk THPBk, the process advances to step S5250. In step S5250, the replacement display flag for the ink tank 2020PBk is set off, and processing of one unit ends.

Figure 7B:
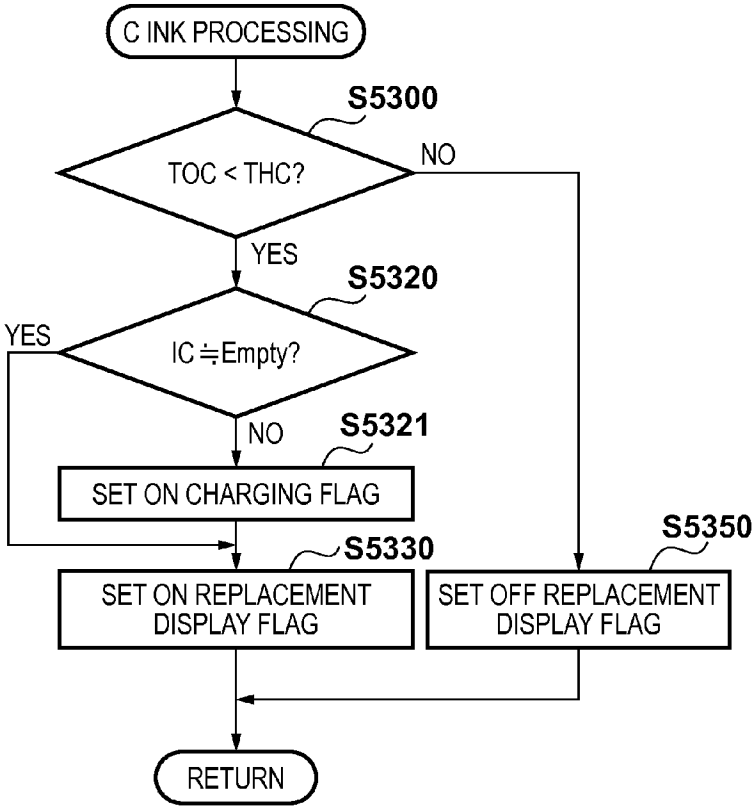
FIG. 7B is a flowchart showing C ink processing.

Referring back to FIG. 5, C ink processing is performed in step S4. This processing is the same as PBk ink processing in step S3, and is processing of setting the charging flag and replacement display flag. FIG. 7B is a flowchart showing the contents.

In step S5300, comparative determination between TOC and a preset threshold THC for the cyan ink supply system is performed. Note that the concrete value of THC in the embodiment is assumed to be 11 ml, similar to THPBk, but is not limited to this.

Processes in steps S5320 to S5330 in a case in which the determination result in step S5300 is YES, that is, TOC<THC are the same as those in steps S5220 to S5230, and a description thereof will not be repeated. Note that the capacity of the sub-tank 2010C in the embodiment is also assumed to be about 18 ml, but is not limited to this. In the processes of steps S5300 to S5330, if the ink tank 2020C should be replaced, the replacement display flag is set on. If the sub-tank 2010C should be charged with ink, the sub-tank charging flag for cyan is set on.

Referring back to step S5300, if the determination result in step S5300 is NO, that is, TOC≥THC, the process advances to step S5350. In step S5350, the replacement display flag for the ink tank 2020C is set off, and processing of one unit ends.

Figure 8A:
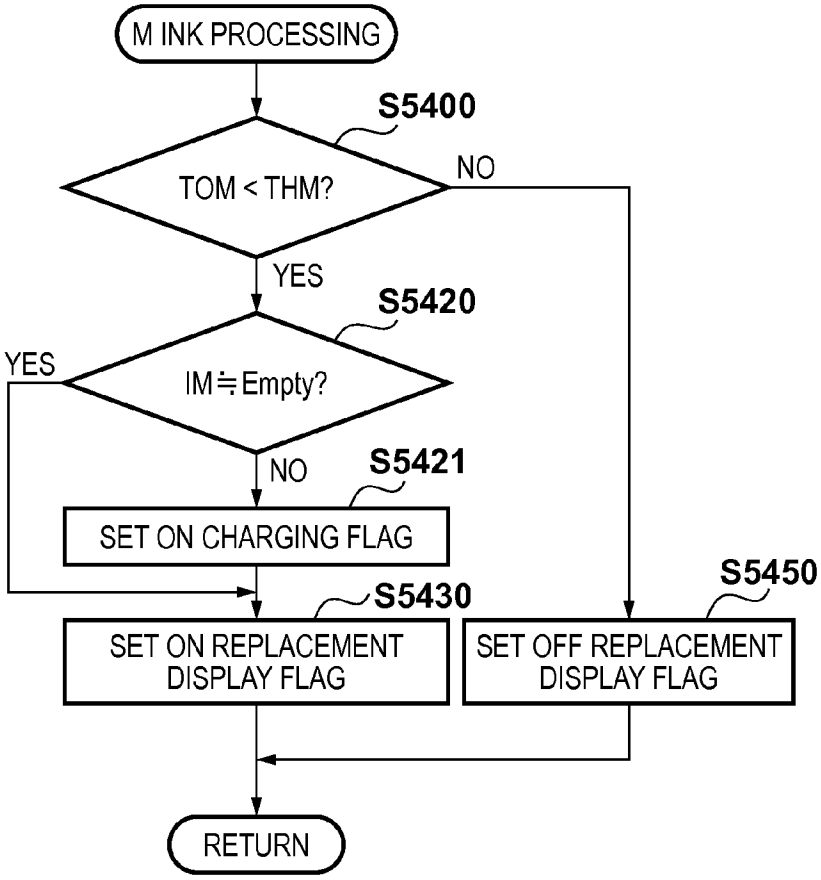
FIG. 8A is a flowchart showing M ink processing.

Referring back to FIG. 5, M ink processing is performed in step S5. This processing is the same as PBk ink processing in step S3 and C ink processing in step S4, and is processing of setting the charging flag and replacement display flag. FIG. 8A is a flowchart showing the contents.

Processes in steps S5400 to S5430 are the same as those in steps S5300 to S5330, and a description thereof will not be repeated. Note that the concrete value of a preset threshold THM for the magenta ink supply system in the embodiment is also assumed to be 11 ml, and the capacity of the sub-tank 2010M is also assumed to be about 18 ml, but the threshold and capacity are not limited to them. In the processes of steps S5400 to S5430, if the ink tank 2020M should be replaced, the replacement display flag is set on. If the sub-tank 2010M should be charged with ink, the sub-tank charging flag is set on.

If the determination result in step S5400 is NO, that is, TOM≥THM, the process advances to step S5450 to set off the replacement display flag for the ink tank 2020M, and processing of one unit ends.

Figure 8B:
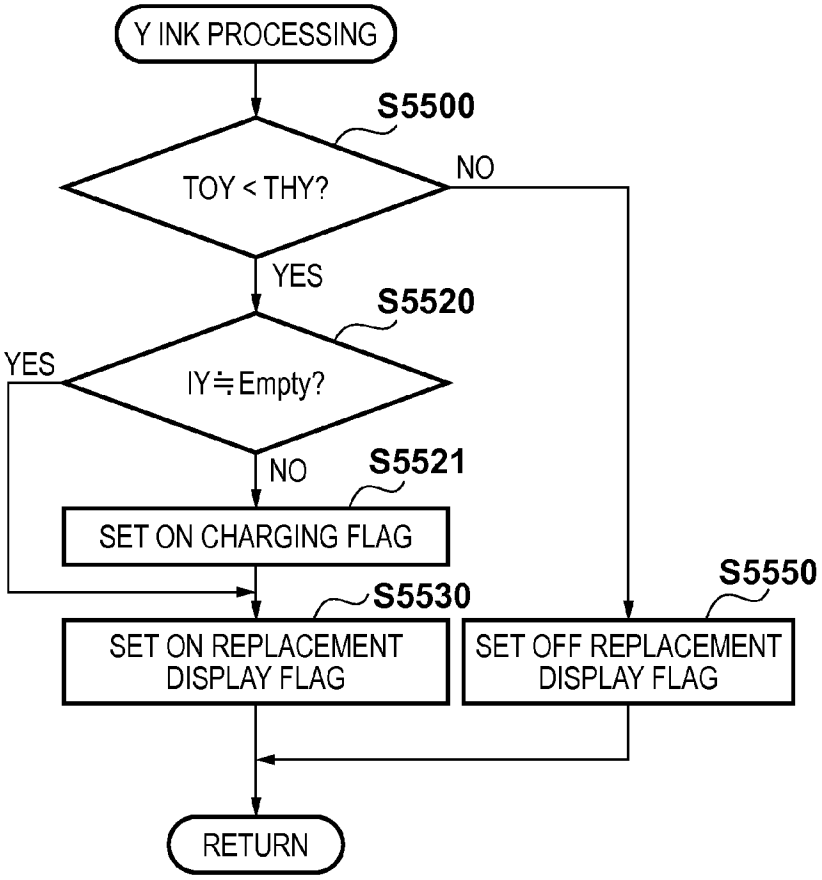
FIG. 8B is a flowchart showing Y ink processing.

Referring back to FIG. 5, Y ink processing is performed in step S6. This processing is the same as ink processes in steps S3 to S5, and is processing of setting the charging flag and replacement display flag. FIG. 8B is a flowchart showing the contents.

In step S5500, comparative determination between TOY and a preset threshold THY for the yellow ink supply system is performed. Note that the concrete value of THY in the embodiment is assumed to be 11 ml, but is not limited to this.

Processes in steps S5520 to S5530 in a case in which the determination result in step S5500 is YES, that is, TOY<THY are the same as those in steps S5220 to S5230, and a description thereof will not be repeated. Note that the capacity of the sub-tank 2010Y in the embodiment is also assumed to be about 18 ml, but is not limited to this. In the processes of steps S5500 to S5530, if the ink tank 2020Y should be replaced, the replacement display flag is set on. If the sub-tank 2010Y should be charged with ink, the sub-tank charging flag is set on.

If the determination result in step S5500 is NO, that is, TOY≥THY, the process advances to step S5550 to set off the replacement display flag for the ink tank 2020Y, and processing of one unit ends.

Figure 9A:
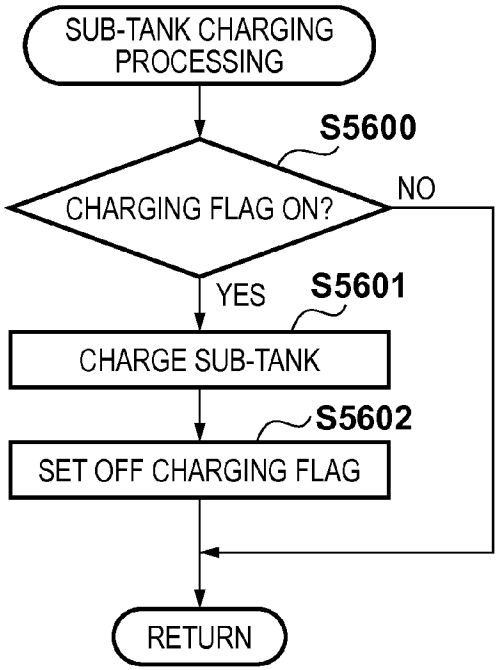
FIG. 9A is a flowchart showing sub-tank charging processing.

Referring back to FIG. 5, sub-tank charging processing is performed in step S7. FIG. 9A is a flowchart showing the sub-tank charging processing.

In step S5600, it is determined whether at least one of the above-described sub-tank charging flags for the respective ink types has been set on. If the determination result is YES in step S5600, that is, even one sub-tank charging flag has been set on, the process advances to step S5601 to perform the sub-tank charging operation. In step S5601, the opening/closing valve 2100 is opened/closed a predetermined number of times.

Note that the number of times by which the opening/closing valve 2100 is opened/closed can be determined from a largest ink remaining amount among ink remaining amounts in the ink tanks 2020 for ink types for which the sub-tank charging flags have been set on. By the sub-tank charging operation, the ink remaining amounts in the ink tanks other than the ink tank 2020MBk become almost 0, the reason of which will be described briefly below.

As described above, when the sub-tank charging flag is ON, the total value of an ink remaining amount in the sub-tank and an ink remaining amount in the ink tank is smaller than 11 ml. To the contrary, the capacity of each sub-tank 2010 is about 18 ml. Thus, all inks remaining in the ink tanks are smaller than the empty amounts of the sub-tanks. This is the reason why the ink remaining amounts in the ink tanks other than the ink tank 2020MBk become almost 0 by the sub-tank charging operation.

In contrast, the ink remaining amount in the ink tank 2020MBk is a maximum of about 3 ml. This is because, when the sub-tank charging flag is ON, TOMBk is smaller than 21 ml, and the capacity of the sub-tank 2010MBk is about 18 ml.

After the end of the sub-tank charging operation in step S5601, the process advances to step S5602 to set off the sub-tank charging flag of each sub-tank. Processing of one unit then ends. If the determination result in step S5600 is NO, that is, none of the sub-tank charging flags has been set on, processing of one unit ends without performing the sub-tank charging operation.

Referring back to FIG. 5, it is determined in step S8 whether at least one of the above-described replacement display flags for the respective ink types has been set on. If the determination result is YES, that is, even one replacement display flag has been set on, the process advances to step S9. If the determination result is NO, that is, all the replacement display flags have been set off, the process advances to step S11.

Figure 9B:
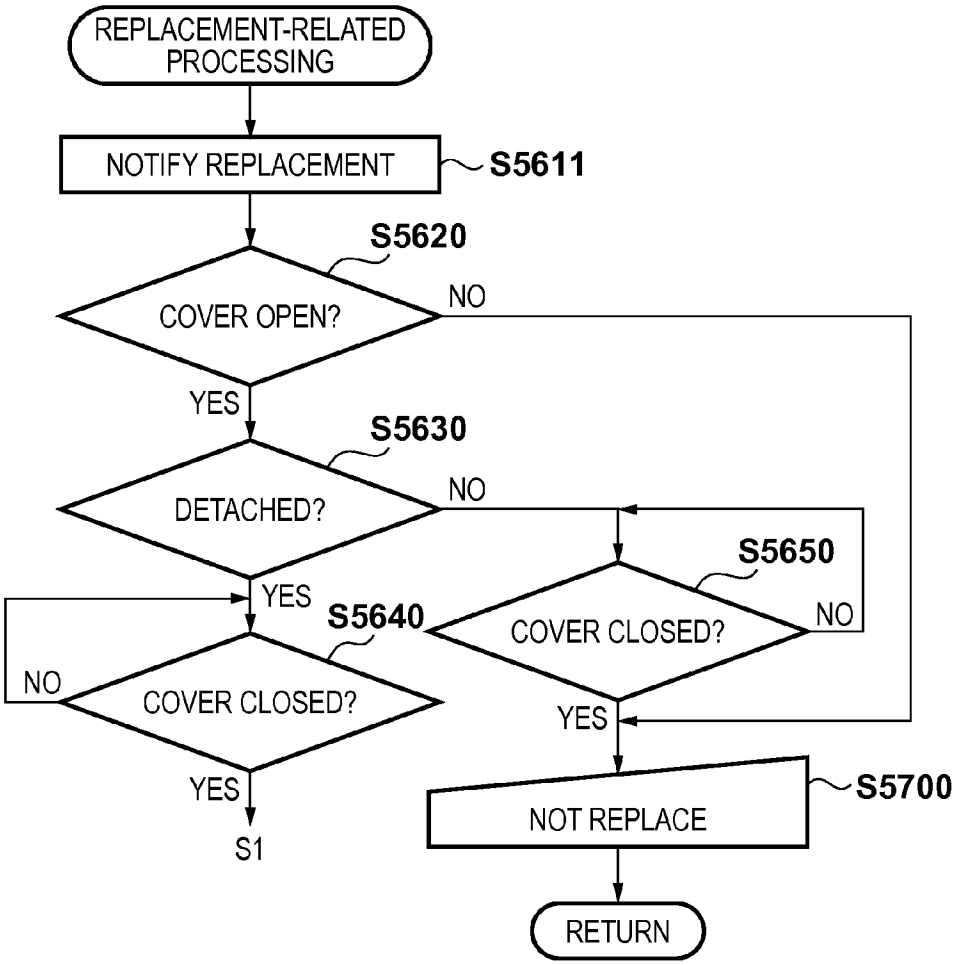
FIG. 9B is a flowchart showing replacement-related processing.

In step S9, replacement-related processing is performed. FIG. 9B is a flowchart showing this processing. In step S5611, a notification is made to prompt the user to replace the ink tank 2020 of an ink type for which the replacement display flag has been set on. The notification can be made by, for example, presenting a predetermined display on the display unit 4095*a*. Alternatively, the notification may be made by sound. Then, the process advances to step S5620.

In step S5620, it is determined whether the user has opened an ink tank cover in order to replace the ink tank upon receiving the notification in step S5611. The ink tank cover is a cover which covers the accommodation space of the ink tank 2020. Opening/closing of the ink tank cover is detected using a known cover opening/closing sensor constituted by a photointerrupter or the like.

If the determination result in step S5620 is YES, that is, the ink tank cover has been opened, the process advances to step S5630 to determine whether the ink tank has been detached and attached. Note that detachment/attachment of the ink tank can be detected by accessing the above-described memory of each ink tank 2020.

If the determination result in step S5630 is YES, that is, the ink tank has been detached and attached, the process advances to step S5640 to determine whether the ink tank cover has been closed.

If the determination result in step S5640 is NO, that is, the ink tank cover has not been closed, the process waits until the ink tank cover is closed.

If the determination result in step S5640 is YES, that is, the ink tank cover has been closed, the process returns to step S1 to repeat the above-described processing again. That is, if it is considered that the ink tank has been replaced, the comparative determination between the ink remaining amount and the threshold, and the other processes are repeated again.

If the determination result in step S5630 is NO, that is, detachment/attachment of the ink tank has not been detected, the process advances to step S5650 to determine whether the ink tank cover has been closed.

If the determination result in step S5650 is NO, that is, the ink tank cover has not been closed, the process waits until the ink tank cover is closed.

If the determination result in step S5650 is YES, that is, the ink tank cover has been closed without replacing the ink tank, the process advances to step S5700.

Referring back to step S5620, if the determination result in step S5620 is NO, that is, the ink tank cover has not been opened, the process advances to step S5700.

In step S5700, the process waits until the user designates not to replace the ink tank. This designation can be input by pressing a predetermined key of the operation unit 4095*b*. If the user inputs the designation, processing of one unit ends. If there is no user designation for a predetermined time, processing of one unit may automatically end. After the notification in step S5611, the user may be allowed to select and designate whether to replace the ink tank. Immediately when the user selects not to replace the ink tank, processing of one unit may end.

In the embodiment, when the ink tank 2020 should be replaced, a notification indicative of this is made to prompt the user to replace the ink tank 2020. However, the user can select not to replace the ink tank 2020 for the following reason.

More specifically, pre-transport preparation processing is assumed to be performed immediately before secondarily transporting the printing apparatus 1. If the user needs to prepare a new ink tank though he is to transport the printing apparatus 1, this may be inconvenient. Therefore, the embodiment employs a sequence not to replace the ink tank even in a situation in which the ink tank should be replaced. If the user replaces the ink tank 2020 in accordance with the notification, replacement display flags are set off for all the ink types. However, if the user does not replace the ink tank, a replacement display flag remains ON for this ink type.

Figure 10:
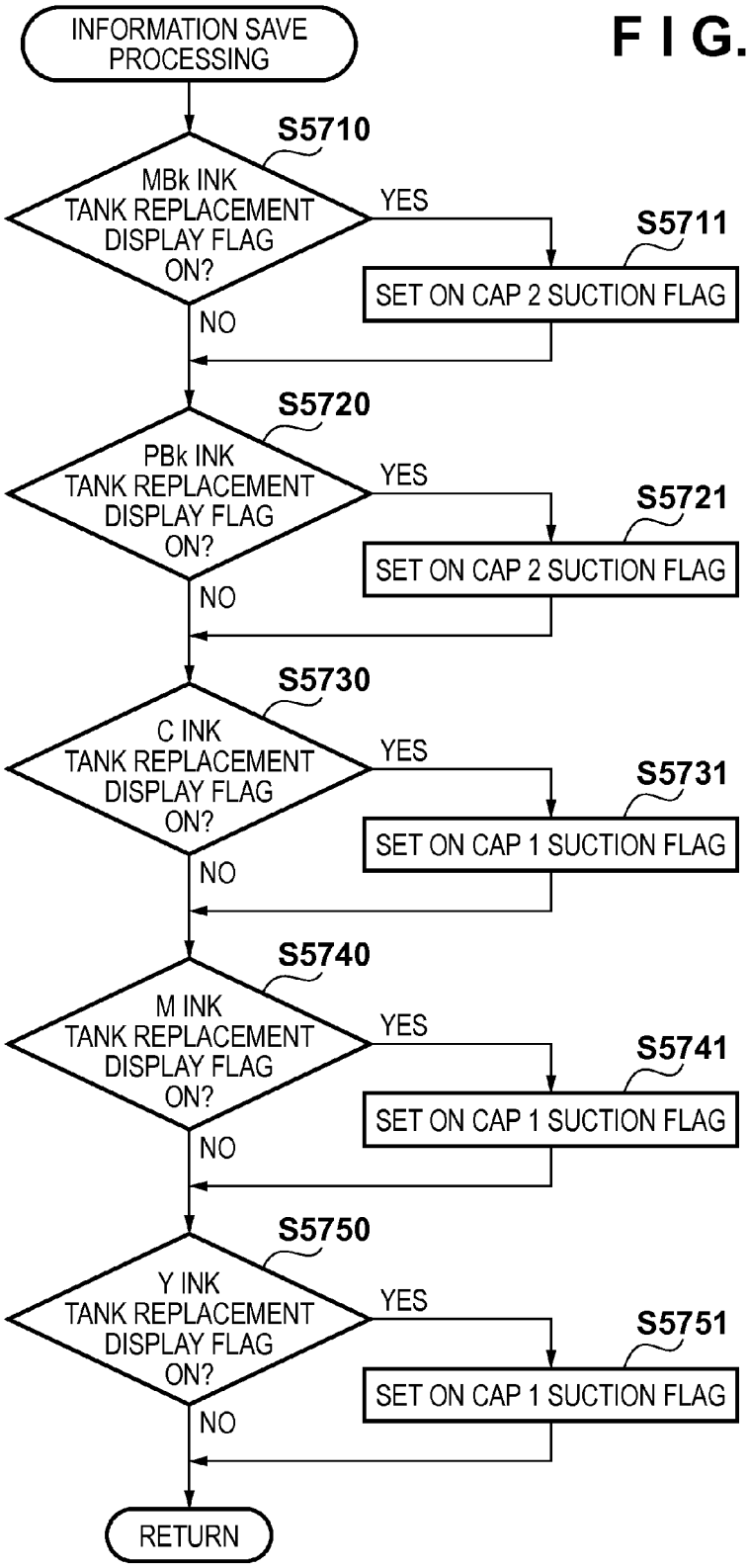
FIG. 10 is a flowchart showing information save processing.

Referring back to FIG. 5, information save processing is performed in step S10. In this case, information about the ink remaining amount of the ink storage section 20 is mainly saved. FIG. 10 is a flowchart showing the information save processing.

In step S5710, it is determined whether the replacement display flag for the ink tank 2020MBk is ON. If the determination result in step S5710 is YES, that is, the replacement display flag for the ink tank 2020MBk is ON, the process advances to step S5711.

In step S5711, a cap 2 flag for the cap 1020 is set on. The cap 1020 is a cap which caps the ink orifice arrays 1001MBk1 and 1001MBk2 communicating with the ink tank 2020MBk. The cap 2 flag is a flag representing whether to replace all the ink remaining amount of the ink supply system (in the printhead 1000 and supply tube 2001) of the ink orifice array 1001 covered with the cap 1020 at start-up after transport. This flag constitutes information about the ink remaining amount of the ink storage section 20, and constitutes particularly information about the result of comparison between the ink remaining amount TO and the threshold TH. As the information about the result of comparison between the ink remaining amount TO and the threshold TH, there is the replacement display flag. In the embodiment, however, negative-pressure suction is performed for each cap. Hence, the cap 2 flag is constituted as information of each cap, including a set of replacement display flags. The cap 2 flag is information representing whether the comparison results of respective ink types indicated by replacement display flags include a comparison result representing a predetermined relationship (here, the ink remaining amount<threshold). This flag is set using, for example, a predetermined area of the NVRAM 4050. After the end of step S5711, the process advances to step S5720.

If the determination result in step S5710 is NO, that is, the replacement display flag for the ink tank 2020MBk is OFF, the process advances to step S5720 without setting on the cap 2 flag.

In step S5720, it is determined whether the replacement display flag for the ink tank 2020PBk is ON. If the determination result in step S5720 is YES, that is, the replacement display flag for the ink tank 2020PBk is ON, the process advances to step S5721. In step S5721, the cap 2 flag for the cap 1020 is set on, as in step S5711. The cap 1020 is a cap which caps the ink orifice array 1001PBk communicating with the ink tank 2020PBk. After the end of step S5721, the process advances to step S5730.

If the determination result in step S5720 is NO, that is, the replacement display flag for the ink tank 2020PBk is OFF, the process advances to step S5730 without setting on the cap 2 flag.

In step S5730, it is determined whether the replacement display flag for the ink tank 2020C is ON. If the determination result is YES, that is, the replacement display flag for the ink tank 2020C is ON, the process advances to step S5731.

In step S5731, a cap 1 flag for the cap 1010 is set on. The cap 1010 is a cap which caps the ink orifice array 1001C communicating with the ink tank 2020C. The cap 1 flag is a flag representing whether to replace all the ink remaining amount of the ink supply system (in the printhead 1000 and supply tube 2001) of the ink orifice array 1001 covered with the cap 1010 at start-up after transport. This flag constitutes information about the ink remaining amount of the ink storage section 20, and constitutes particularly information about the result of comparison between the ink remaining amount TO and the threshold TH. As the information about the result of comparison between the ink remaining amount TO and the threshold TH, there is the replacement display flag. In the embodiment, however, negative-pressure suction is performed for each cap. Thus, the cap 1 flag is constituted as information of each cap, including a set of replacement display flags. The cap 1 flag is information representing whether the comparison results of respective ink types indicated by replacement display flags include a comparison result representing a predetermined relationship (here, the ink remaining amount<threshold). This flag is set using, for example, a predetermined area of the NVRAM 4050. After the end of step S5731, the process advances to step S5740.

If the determination result in step S5730 is NO, that is, the replacement display flag for the ink tank 2020C is OFF, the process advances to step S5740 without setting on the cap 1 flag.

Similarly, in the processes of steps S5740 and S5741, if the replacement display flag for the ink tank 2020M is ON, the cap 1 flag for the cap 1010 is set on. The cap 1010 is also a cap which caps the ink orifice array 1001M. If the replacement display flag for the ink tank 2020M is OFF, the process advances to step S5750 without setting on the cap 1 flag.

In the processes of steps S5750 and S5751, if the replacement display flag for the ink tank 2020Y is ON, the cap 1 flag is set on, and processing of one unit ends. If the replacement display flag for the ink tank 2020Y is OFF, processing of one unit ends without setting on the cap 1 flag. The cap 1010 is also a cap which caps the ink orifice array 1001Y.

Referring back to FIG. 5, ink suction processing is executed in step S11. In the suction processing, both the caps 1010 and 1020 are positioned at the capping position. The suction pump 1030 is driven to suck ink at a negative pressure from all the ink orifice arrays 1001 of the printhead 1000 and drain the ink.

Let the suction draining amount per ink orifice array be a suction amount A. Note that the concrete value of the suction amount A in the embodiment is assumed to be about 10 ml, but is not limited to this. The ink suction amount can be controlled by, for example, the operation amount or operation time of the suction pump 1030.

The suction amount A is set to be a value at which ink does not leak from each air communication section 2030 when the printing apparatus 1 is transported in a state in which all the ink tanks 2020 are detached from the printing apparatus 1. For example, as the transport conditions, assume that the maximum tilt angle of the printing apparatus 1 is about 30°, and ambient temperature fluctuations in a state in which the printing apparatus 1 tilts by 30° are not so large. The suction amount A can be set so that ink in the air communication section 2030 does not leak from the air communication port 2032 of the air communication section 2030 under these transport conditions. For example, in the aforementioned transport conditions, the estimated ink remaining amount of the air communication section 2030 at which ink is estimated not to leak is calculated. Then, the suction amount A can be calculated from the capacity of the air communication section 2030 and the estimated ink remaining amount. For example, suction amount A≥capacity—estimated ink remaining amount.

Here, the relationship between the suction amount A, and the threshold TH for the supply system of each ink type will be explained.

In the above-described processing, when the total value TO of an ink remaining amount in the sub-tank 2010 and an ink remaining amount in the ink tank 2020 is smaller than the threshold TH, the user is prompted to replace the ink tank, in order to prevent the sub-tank 2010 from becoming empty after suction draining by the suction amount A. That is, the threshold TH is set to be an ink amount equal to or larger than the suction amount A.

For mat black ink, there are the two ink orifice arrays 1001. The suction amount is the suction amount A×2=20 ml. To satisfy the relation of suction amount<threshold TH, the threshold THMBk is 21 ml. In this fashion, the threshold TH is set for each ink type in accordance with the number of ink orifices of each ink type. As for inks other than mat black ink, the numbers of ink orifices are equal, and the thresholds TH are also equal. The threshold TH can be set to be a value equal to or larger than a value obtained by multiplying the number of ink orifice arrays by the suction amount A.

Since the ink amount in the air communication section 2030 greatly varies depending on ambient temperature fluctuations and the like, it is difficult to accurately grasp the ink amount. In the embodiment, the suction amount A is set in consideration of a maximum ink amount in the air communication section 2030. However, the minimum value of the ink amount in the air communication section 2030 is almost 0. If the total value TO is smaller than the threshold TH, the sub-tank 2010 may become empty.

Emptying of the sub-tank 2010 means that air enters the supply tube 2001. Since the internal diameter of the supply tube 2001 is small, air in the supply tube 2001 moves toward the printhead 1000 along with ink discharge. When the air reaches the ink orifice, a so-called discharge failure occurs not to discharge ink. It is therefore necessary to suck and drain air in the supply tube 2001.

For this purpose, ink in the printhead 1000 and supply tube 2001 needs to be sucked and drained using the suction pump 1030 in a state in which a sufficient amount of ink exists in the sub-tank 2010. That is, ink of this amount becomes so-called waste ink. This is the reason why the user is prompted to replace the ink tank 2020 when the total value TO is smaller than the threshold TH.

As already described above, however, it may be inconvenient that replacement of the ink tank 2020 is indispensable immediately before transporting the printing apparatus 1.

Thus, in the embodiment, when air may enter the supply tube 2001, the flags (cap 1 flag and cap 2 flag) are set on to cope with the air by post-transport processing. This makes secondary transport possible without replacing the ink tank.

The threshold THMBk for the mat black ink supply system is almost double the threshold for the remaining ink supply systems because there are the two ink orifice arrays 1001MBk1 and 1001MBk2 communicating with the sub-tank 2010MBk. Only for mat black ink, ink stored in the sub-tank 2010MBk and ink tank 2020MBk is decreased by almost two times the amount for inks of the remaining types by the suction draining operation in the suction amount A.

Referring back to FIG. 5, after the end of the suction draining operation in step S11, the process advances to step S12 to close all the opening/closing valves 2100, in order not to damage a meniscus formed in the ink orifice even if the printing apparatus 1 is greatly tilted at the time of secondary transport. Unless the meniscus is damaged, neither air inflow nor ink outflow from the ink orifice occurs. Therefore, even if the printing apparatus 1 is greatly tilted, no ink leaks.

More specifically, the internal diameter of the feeding needle 2011 arranged in the sub-tank 2010 is very small, and no gas-liquid exchange is performed in the feeding needle 2011. As long as there is no air inflow from the ink orifice, even if the printing apparatus 1 is greatly tilted, no ink leaks from the sub-tank 2010.

After step S12, the process advances to step S13 and waits until all the ink tanks 2020 are separated from the printing apparatus 1. In short, the process waits until the user detaches the ink tanks 2020.

After all the ink tanks 2020 are detached from the printing apparatus 1, the process advances to step S14 to set on a secondary transport flag. The secondary transport flag is a flag used in post-transport start-up processing, and is set using, for example, a predetermined area of the NVRAM 4050.

Then, the process advances to step S15 to automatically turn off the printing apparatus 1. Accordingly, pre-transport preparation processing of one unit ends.

In this state, secondary transport of the printing apparatus 1 according to the embodiment is executed. At this time, the caps 1010 and 1020 are positioned at the capping position.

Figure 11:
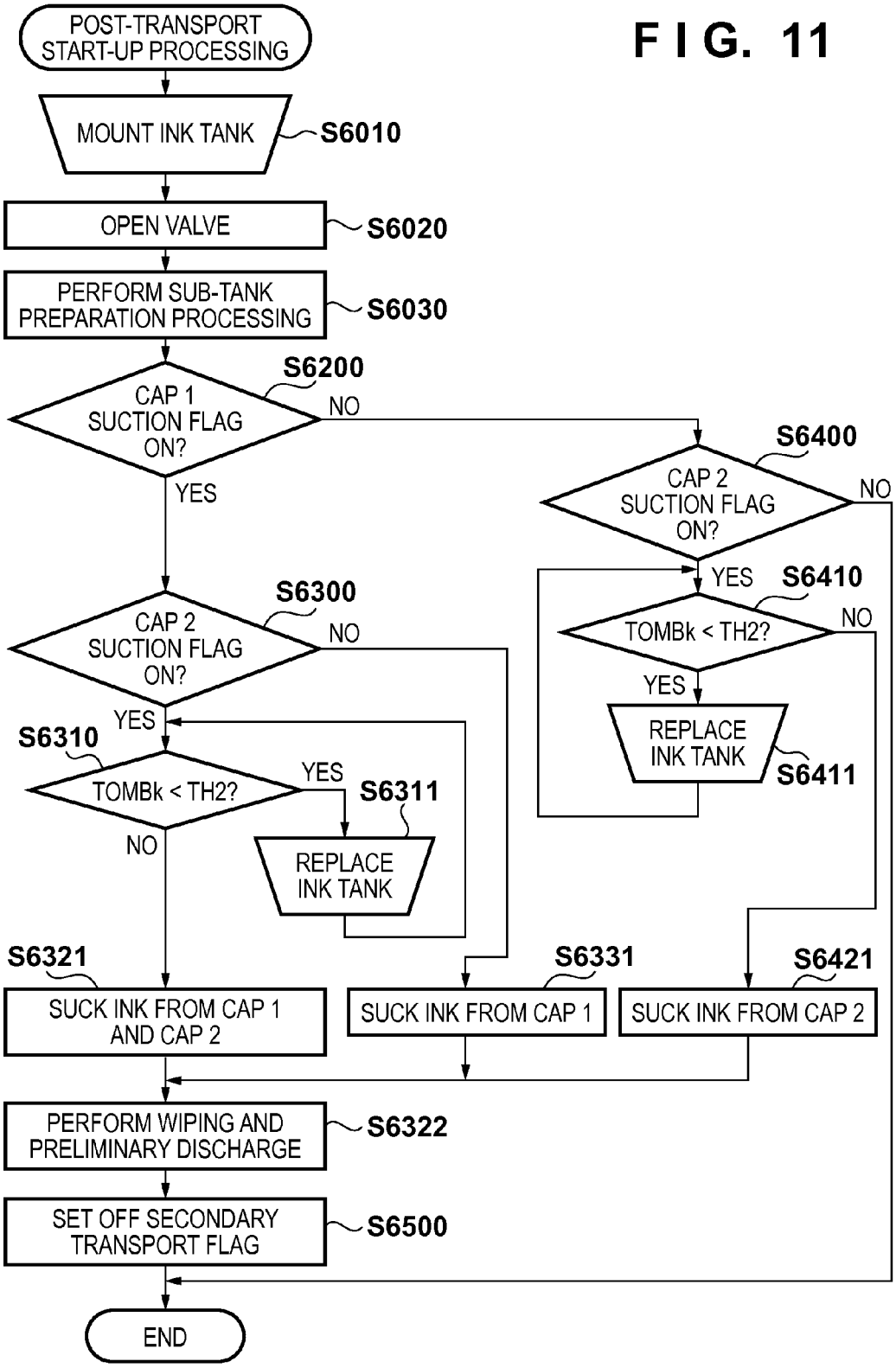
FIG. 11 is a flowchart showing an example of post-transport start-up processing.

Next, post-transport processing will be described with reference to FIG. 11. FIG. 11 is a flowchart showing an example of post-transport start-up processing to be executed by the CPU 4020 after transporting the printing apparatus 1. The post-transport start-up processing is executed when a predetermined start-up condition is satisfied. The embodiment assumes that the start-up condition is satisfied when the secondary transport flag is ON. More specifically, when the printing apparatus 1 is turned on, the CPU 4020 checks the secondary transport flag, and if this flag is ON, automatically executes the processing in FIG. 11. Another example in which the start-up condition is satisfied is a case in which the user performs a predetermined operation on the operation unit 4095*b*. Still another example is a case in which the user performs a predetermined operation on the host computer 4500 to issue a processing start instruction from the host computer 4500 to the printing apparatus 1.

In step S6010, the process waits until all the ink tanks 2020 are attached to the printing apparatus 1. If it is confirmed that all the ink tanks 2020 are attached to the printing apparatus 1, the process advances to step S6020 to open all the opening/closing valves 2100.

Figure 12:
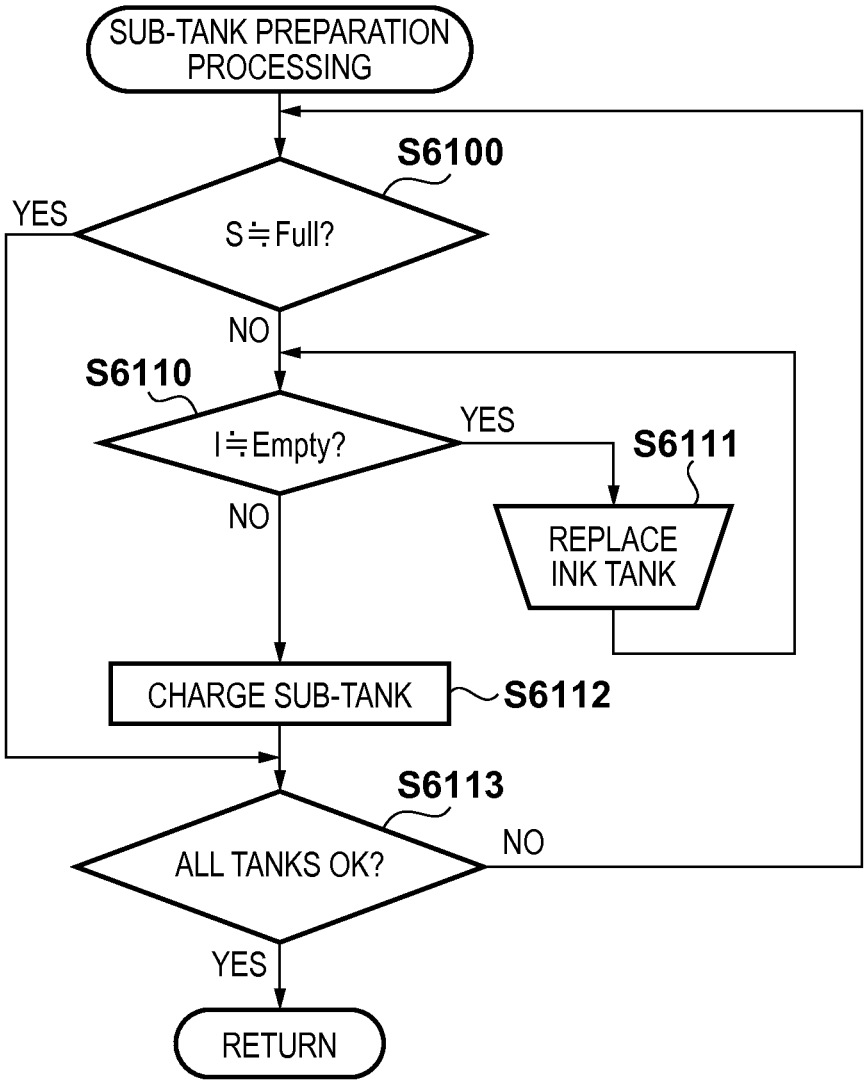
FIG. 12 is a flowchart showing sub-tank preparation processing.

After that, the process advances to step S6030 to execute sub-tank preparation processing. FIG. 12 is a flowchart showing this processing. In step S6100, it is determined based on the detection result of the sensor 2012 whether the sub-tank 2010 to be processed is full.

If the determination result in step S6100 is NO, that is, the sub-tank 2010 to be processed is not full, the process advances to step S6110. In step S6110, it is determined based on the detection result of the sensor 2021 whether the ink tank 2020 communicating with the sub-tank 2010 to be processed is almost empty.

If the determination result in step S6110 is YES, that is, the ink tank 2020 is almost empty, the process advances to step S6111 and waits until the ink tank is replaced. After the ink tank 2020 is replaced, the process returns to step S6110.

If the determination result in step S6110 is NO, that is, the ink tank 2020 is not almost empty, the process advances to step S6112. In step S6112, the sub-tank charging operation is performed. That is, the opening/closing valve 2100 is opened/closed a predetermined number of times. Note that the number of times of opening/closing of the opening/closing valve 2100 at this time in the embodiment is 10.

After the end of step S6112, the process advances to step S6113. In step S6113, it is determined whether the processes in steps S6100 to S6112 have been performed for inks of all the types. If the determination result is NO, an unprocessed sub-tank 2010 is set as the sub-tank 2010 to be processed, and then the process returns to step S6100. If the determination result is YES, processing of one unit ends.

Referring back to FIG. 11, it is determined in step S6200 whether the cap 1 flag is ON. If the determination result in step S6200 is YES, that is, the cap 1 flag is ON, the process advances to step S6300 to determine whether the cap 2 flag is ON.

If the determination result in step S6300 is YES, that is, both the cap 1 flag and cap 2 flag are ON, the process advances to step S6310.

The ON state of the cap 1 flag indicates the possibility that at least one of the sub-tanks 2010C, 2010M, and 2010Y is empty at the time of transport. Similarly, the ON state of the cap 2 flag indicates the possibility that at least either of the sub-tanks 2010MBk and 2010PBk is empty at the time of transport. The possibility that the sub-tank is empty represents the possibility that air is entered in the supply tube 2001.

In step S6310, the ink remaining amount TOMBk of the ink storage section 20MBk is detected and calculated, and it is determined whether the TOMBk value is smaller than a second threshold TH2. Note that the concrete value of TH2 in the embodiment is assumed to be 29 ml, the reason of which will be described later.

If the determination result in step S6310 is YES, that is, TOMBk is smaller than TH2, the process advances to step S6311 and waits until the ink tank 2020MBk is replaced. After the ink tank 2020MBk is replaced, the process returns to step S6310.

If the determination result in step S6310 is NO, that is, TOMBk is equal to or larger than TH2, the process advances to step S6321.

In step S6321, ink is sucked and drained from all the ink orifice arrays 1001 by driving the suction pump 1030 in a state in which the caps 1010 and 1020 are positioned at the capping position. Let the suction draining amount per ink orifice array at this time be a suction amount B. Note that the concrete value of the suction amount B in the embodiment is assumed to be about 14 ml, but the present invention is not limited to this. The suction amount B is an amount for sucking and draining air which may enter the supply tube 2001. That is, the suction amount B is an amount by which the above-mentioned ink in the printhead 1000 and supply tube 2001 can be sucked and drained.

Note that the second threshold TH2 is set to be a value at which the sub-tank 2010MBk does not become empty by the suction draining operation in the suction amount B. In other words, the second threshold TH2 is set to be a value at which air does not enter the supply tubes 2001MBk1 and 2001MBk2. By the suction draining operation in the suction amount B, mat black ink stored in the sub-tank 2010MBk and ink tank 2020MBk decreases to about 14 ml×two arrays=about 28 ml. If the second threshold TH2 is set to be 29 ml, as described above, the sub-tank 2010MBk does not become empty.

If the suction amount B is set to be about 14 ml, as described above, the sub-tank 2010 does not become empty after the suction draining operation as for the sub-tanks (capacity of about 18 ml) except for the sub-tank 2010MBk. This is because the sub-tanks 2010 are filled up before the suction draining operation.

More specifically, air which may enter the supply tube 2001 is sucked and drained by the suction draining operation in the suction amount B. At the same time, the insides of the printhead 1000 and supply tube 2001 are filled with ink.

After the end of step S6321, the process advances to step S6322 to perform a known recovery operation including a wiping operation and preliminary discharge operation. Then, the secondary transport flag is set off (step S6500), and processing of one unit ends.

If the determination result in step S6300 is NO, that is, the cap 1 flag is ON but the cap 2 flag is OFF, the process advances to step S6331.

In step S6331, the suction draining operation of only the cap 1010 in the suction amount B is performed. More specifically, ink is sucked and drained by about 14 ml from each of the ink orifice arrays 1001C, 1001M, and 1001Y. At this time, only the cap 1010 is positioned at the capping position, and the suction pump 1030 is driven, as described above. Ink is neither sucked nor drained from the cap 1020. Hence, ink remaining in the ink orifice arrays 1001MBk and 1001PBk and the supply tubes 2001MBk and 2001PBk is not wasted but is used.

After the end of step S6331, the process advances to step S6322 to perform a known recovery operation including a wiping operation and preliminary discharge operation. Then, the secondary transport flag is set off (step S6500), and processing of one unit ends.

If the determination result in step S6200 is NO, that is, the cap 1 flag is OFF, the process advances to step S6400 to determine whether the cap 2 flag is ON. If the determination result in step S6400 is YES, that is, the cap 1 flag is OFF but the cap 2 flag is ON, the process advances to step S6410. Processes in steps S6410 and S6411 are the same as those in steps S6310 and S6311, and a description thereof will not be repeated.

In step S6421, the suction draining operation of only the cap 1020 in the suction amount B is performed. More specifically, ink is sucked and drained by about 14 ml from each of the ink orifice arrays 1001MBk1, 1001MBk2, and 1001PBk. Thus, ink remaining in the ink orifice arrays 1001C, 1001M, and 1001Y and the supply tubes 2001C, 2001M, and 2001Y is not wasted but is used.

After the end of step S6421, the process advances to step S6322 to perform a known recovery operation including a wiping operation and preliminary discharge operation. Then, the secondary transport flag is set off (step S6500), and processing of one unit ends.

If the determination result in step S6400 is NO, that is, both the cap 1 flag and cap 2 flag are OFF, the secondary transport flag is set off (step S6500) without performing the suction draining operation and another processing. Ink remaining in each ink orifice array 1001 and each supply tube 2001 is not wasted but is used. Thereafter, processing of one unit ends.

As described above, in post-transport start-up processing, the supply tube 2001 which air may enter undergoes the suction draining operation by the suction amount B from a cap corresponding to the ink orifice array 1001 communicating with the supply tube 2001. At this time, the suction draining operation is performed for each group of the ink orifice arrays 1001. More specifically, when there is not the possibility that air enters the ink supply system for the group of the ink orifice arrays 1001 corresponding to the cap 1010, the suction draining operation of the cap 1010 is not performed. Similarly, when there is not the possibility that air enters the ink supply system for the group of the ink orifice arrays 1001 corresponding to the cap 1020, the suction draining operation of the cap 1020 is not performed. Note that the case in which there is not the possibility that air enters the ink supply system is a case in which it is determined in pre-transport preparation processing that the ink remaining amount is equal to or larger than the threshold.

As described above, according to the embodiment, execution of the printing operation in a state in which air enters the ink supply system can be prevented while reducing the waste ink amount at the time of secondary transport.

In the above description, the suction draining operation in the suction amount B is performed by driving the suction pump 1030 in a state in which the opening/closing valve 2100 is open. However, another method is also available. For example, the suction pump 1030 is driven in a state in which the opening/closing valve 2100 is closed. That is, a high negative pressure is built up in the printhead and supply tube. Then, the opening/closing valve 2100 is opened to suck ink at the negative pressure. By repeating this operation a plurality of times, the suction draining operation in the suction amount B can be performed.

In the above description, the suction draining operation is not performed for a cap for which the cap flag is OFF. However, the suction draining operation in a suction amount C may be performed to recover the ink discharge performance. That is, in accordance with ON or OFF of the cap flag, the suction amount in the suction draining operation may be controlled between the suction amount A and the suction amount C smaller than the suction amount A. The suction amount C is a suction draining amount per ink orifice array, and can be several ml (for example, 1 ml).

Second Embodiment

Figure 17:
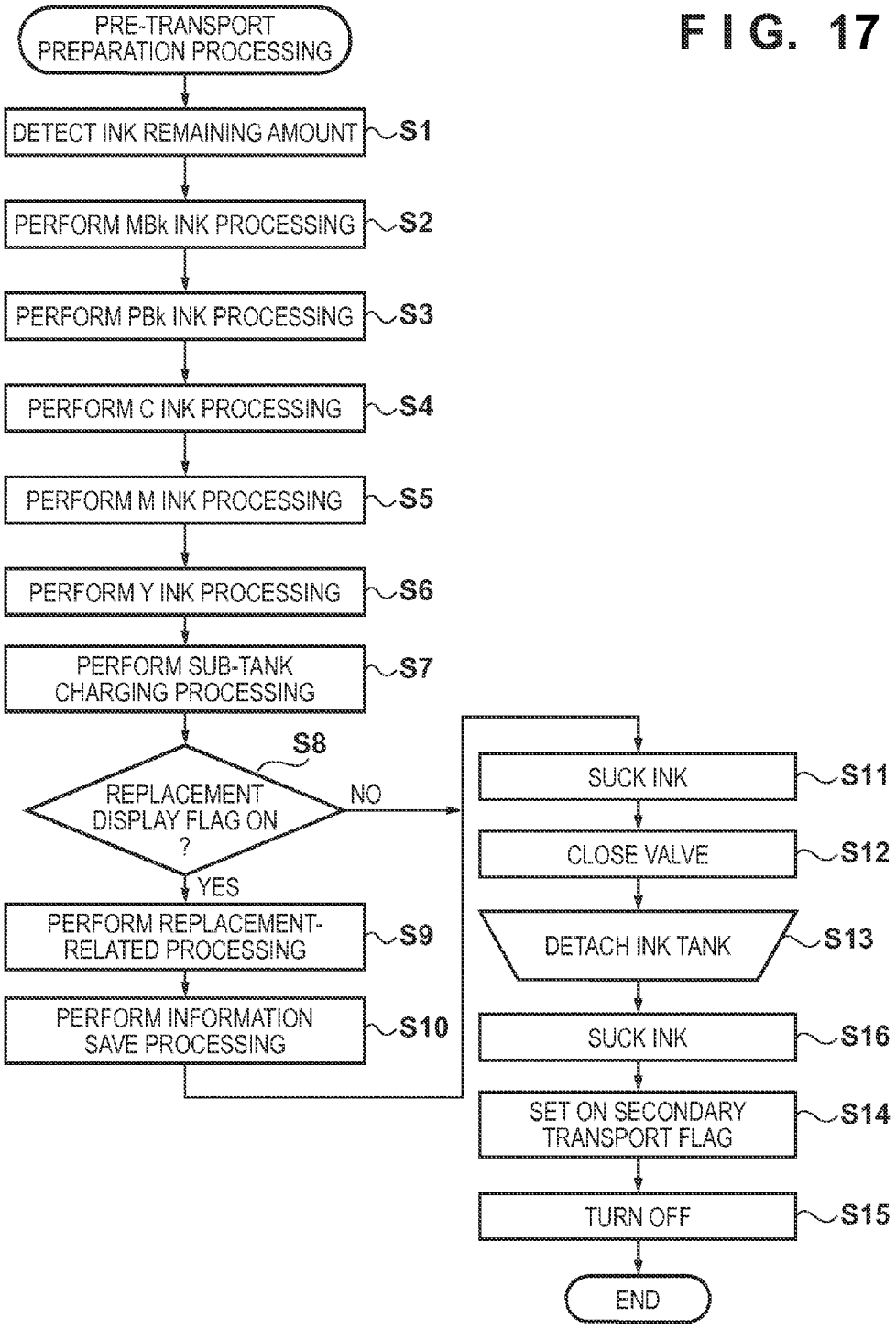
FIG. 17 is a flowchart showing an example of pre-transport preparation processing in accordance with yet another embodiment.

The ink suction amount in pre-transport preparation processing (FIG. 5) is the suction amount A (step S11) in the first embodiment, but the present invention is not limited to this. The suction ink amount may be controlled based on the cap flag. In the second embodiment, as shown in FIG. 17, for an ink supply system in which air may be mixed, ink is sucked and drained by an ink amount larger than that for an ink supply system in which no air may be mixed. More specifically, for an ink supply system in which air may be mixed, the entire amount of remaining ink is drained from a printhead 1000, supply tube 2001, and sub-tank 2010 at the stage of pre-transport preparation processing. An example will be explained below.

First, the suction draining operation in the suction amount A is performed in step S11 for both caps 1010 and 1020, as in the first embodiment. This prevents leakage of ink from an air communication section 2030. In the embodiment, remaining ink is drained from the sub-tank 2010 for an ink supply system in which air may be mixed, as described above. Therefore, for an ink supply system for which the replacement flag becomes ON, no sub-tank charging processing in FIG. 9A is performed. This can reduce the waste ink amount.

After the processing in step S11, an ink tank 2020 is detached in step S13, and the suction draining operation is further performed by a suction amount D for a cap for which the cap flag is ON (step S16). For example, if the cap 1 flag is ON, the suction draining operation is performed by the suction amount D for the cap 1010. If the cap 2 flag is ON, the suction draining operation is performed by the suction amount D for the cap 1020.

The suction amount D is a suction draining amount per ink orifice array, and is about 32 ml in the embodiment on the assumption that some sub-tanks 2010 are full. As described above, according to the embodiment, the suction draining operation is performed for each cap. If the ink suction draining operation is performed for the cap 1010, mat black and photo black inks are sucked. If the ink suction draining operation is performed for the cap 1020, cyan, magenta, and yellow inks are sucked. In this arrangement, a plurality of types of inks are simultaneously sucked by one cap, and the cap flag is a flag for each cap. For example, when the cap 2 flag is ON, a magenta sub-tank 2010M may be full, and a yellow sub-tank 2010Y may be almost empty.

For this reason, the suction amount D is set to be about 32 ml, a breakdown of which is as follows. In the embodiment, the amount by which ink is sucked and drained from the printhead 1000 and supply tube 2001 is about 14 ml for each ink type. In the embodiment, the capacity of the sub-tank 2010 is about 18 ml. The sum of these values is about 32 ml. By performing the suction draining operation in the suction amount D, the entire amount of ink in the ink supply system is drained.

Next, post-transport start-up processing (FIG. 11) in the second embodiment is the same as that in the first embodiment. More specifically, the sub-tank 2010 is filled up in step S6030 of FIG. 11. In processing of each of steps S6321, S6331, and S6421, the suction draining operation in the suction amount B is performed. The insides of the printhead 1000 and supply tube 2001 can therefore be filled with ink. In this suction draining operation, almost ink exists in the printhead 1000 and supply tube 2001, and ink is actually sucked and drained by only a very small amount.

Third Embodiment

Figure 13:
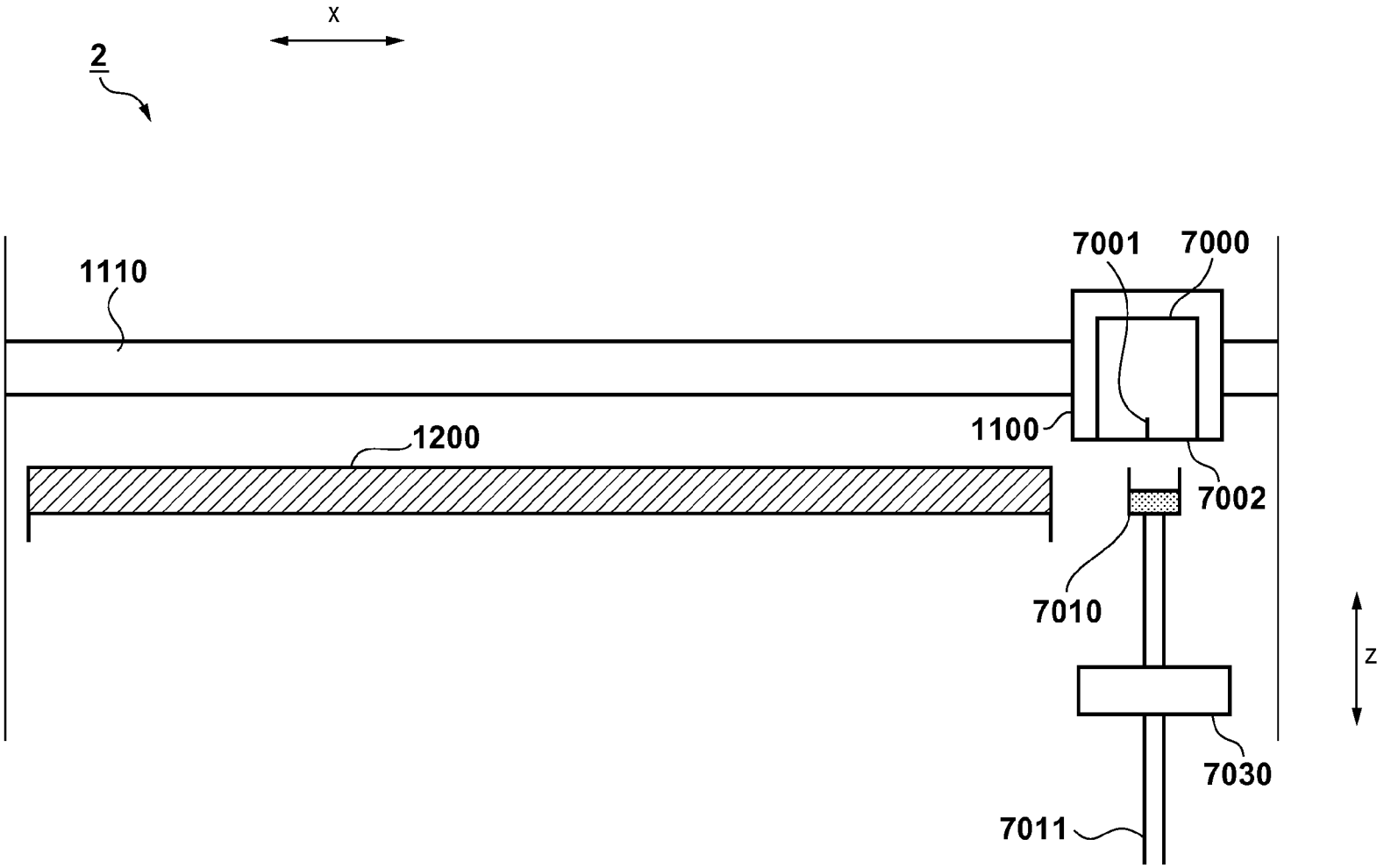
FIG. 13 is a schematic view showing a printing apparatus according to another embodiment.

The first embodiment has exemplified the arrangement in which a plurality of types (five types) of inks are discharged. However, an arrangement in which a single color ink is discharged is possible. An arrangement including no sub-tank 2010 can also be employed. FIG. 13 is a schematic view showing a printing apparatus 2 according to the third embodiment. The same reference numerals as those in the printing apparatus 1 denote the same parts, and a description thereof will not be repeated.

A printhead 7000 according to the embodiment includes an ink orifice array 7001 which is arranged on an ink discharge face 7002 and discharges ink. The ink orifice array 7001 discharges, for example, black ink.

As in the first embodiment, a cap 7010 can be reciprocated between the capping position and the distant position. A suction pump 7030 is connected to the cap 7010 via a pump tube 7011. The suction pump 7030 can suck the inside of the cap 7010 to a negative pressure. Ink sucked and drained by driving the suction pump 7030 is accommodated in a maintenance cartridge (not shown) configured to be freely detachable from the printing apparatus 2. The cap 7010 incorporates an ink absorber.

Figure 14:
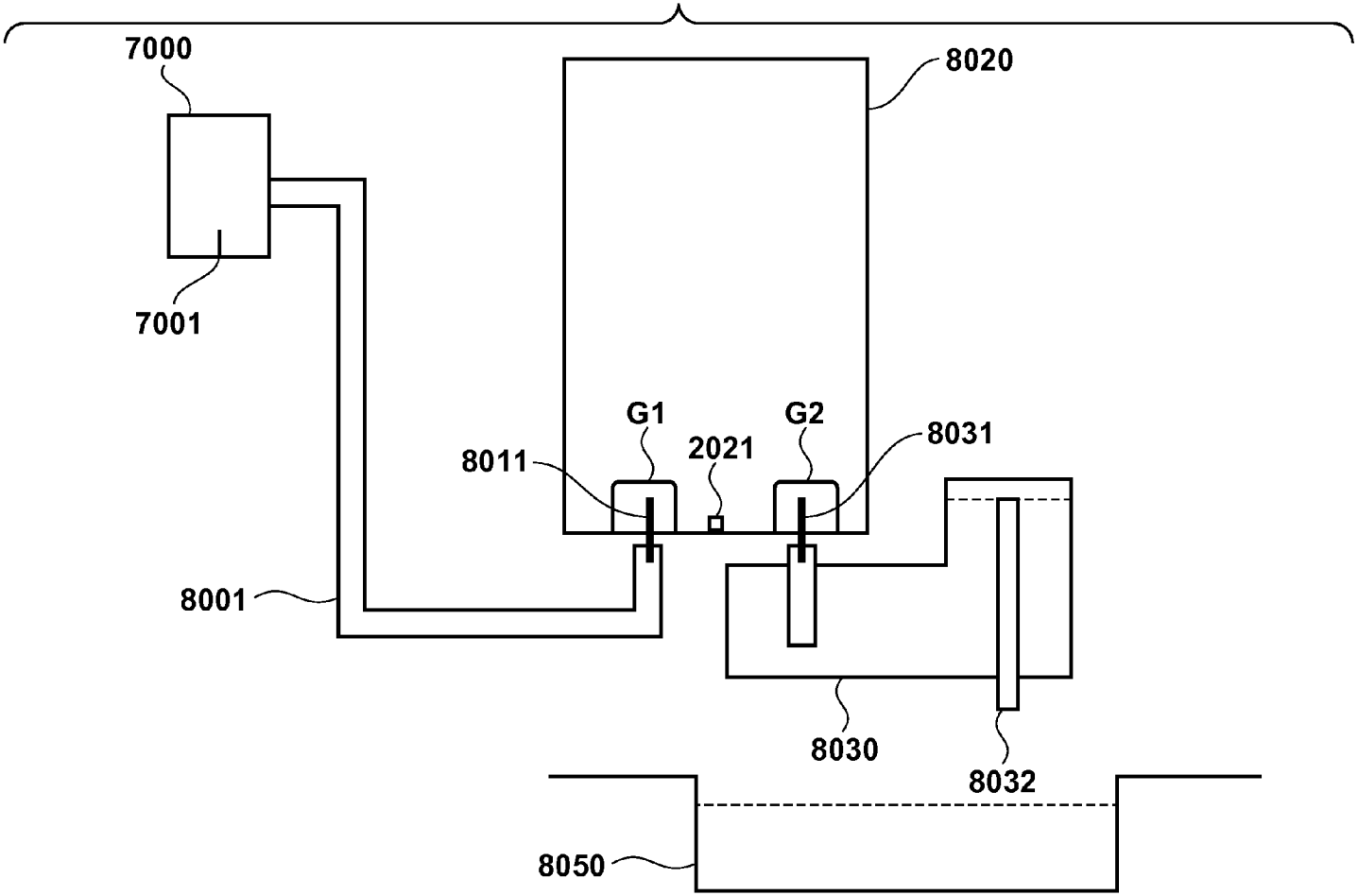
FIG. 14 is a schematic view showing an example of the arrangement of an ink supply system according to the other embodiment.

Next, the arrangement of the ink supply system for the printhead 7000 will be described with reference to FIG. 14. FIG. 14 shows the arrangement of the ink supply system for the ink orifice array 7001.

The ink orifice array 7001 of the printhead 7000 communicates with an ink tank 8020 through a supply tube 8001 and hollow feeding needle 8011. That is, there is no sub-tank, and the ink storage section is constituted by the ink tank 8020.

The ink tank 8020 communicates with an air communication section 8030 through a hollow feeding needle 8031. Note that the air communication section 8030 has an air communication port 8032. When the ink tank 8020 is attached to the printing apparatus 2, the feeding needles 8011 and 8031 extend through rubber plugs G1 and G2 of the ink tank 8020, respectively.

As in the first embodiment, the ink liquid level in the air communication section 8030 is designed to be lower than the ink discharge face 7002 of the printhead 7000 in the direction of gravity. By a so-called water head difference, the inside of the printhead 7000 is kept at a negative pressure. It is also configured not to damage a meniscus formed in the ink orifice by the water head difference.

In addition, the printing apparatus 2 includes a fail safe ink accommodation section 8050. Even if the ink tank 8020 is damaged, leaking ink is accommodated in the ink accommodation section 8050. Note that the ink accommodation section 8050 incorporates an ink absorber.

Further, as in the first embodiment, the printing apparatus 2 includes a sensor 2021 which detects an ink remaining amount in the ink tank 8020. The ink remaining amount in the ink tank 8020 can be detected by the sensor 2021 and a dot counter. The ink tank 8020 can also be equipped with a memory for storing an ink remaining amount. By accessing this memory, the control unit of the printing apparatus 2 can confirm attachment/detachment of the ink tank 8020. The arrangement of the control system of the printing apparatus 2 is the same as that in the first embodiment.

Next, secondary transport of the printing apparatus 2 will be explained. The third embodiment assumes that the printing apparatus 2 is transported in a state in which the ink tank 8020 is attached. This is because, even if the ink tank 8020 is damaged, leaking ink can be accommodated in the ink accommodation section 8050.

Figure 15:
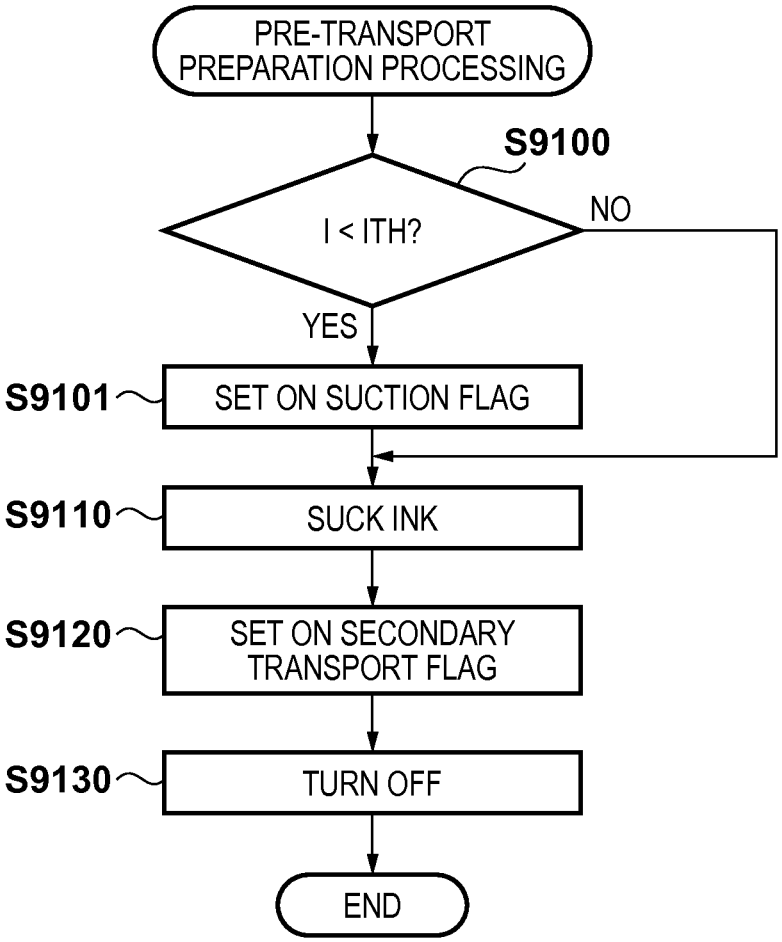
FIG. 15 is a flowchart showing an example of pre-transport preparation processing according to the other embodiment.

FIG. 15 is a flowchart showing an example of pre-transport preparation processing according to the third embodiment. The pre-transport preparation processing in FIG. 15 starts when a predetermined transport-preparation condition is satisfied, as in the first embodiment.

In step S9100, an ink remaining amount I of the ink tank 8020 is detected by the sensor 2021 and dot counter, and compared with a preset threshold ITH. The concrete value of ITH is assumed to be 8 ml, but is not limited to this.

If the determination result is YES, that is, the ink remaining amount I is smaller than the threshold ITH, the process advances to step S9101 to set on a suction flag. The suction flag is equivalent to the cap flag in the first embodiment. When the ink remaining amount I is smaller than ITH, air may enter the supply tube 8001 by the suction draining operation in a suction amount $\alpha$ (to be described later) in step S9110. The suction flag represents the possibility that air enters the supply tube. After the suction flag is set on, the process advances to step S9110.

If the determination result in step S9100 is NO, that is, the ink remaining amount I is equal to or larger than the threshold ITH, the process advances to step S9110 without setting on the suction flag.

In step S9110, ink is sucked and drained from the ink orifice array 7001 by driving the suction pump 7030 in a state in which the cap 7010 is positioned at the capping position. The suction draining amount at this time is the suction amount a. The concrete value is about 7 ml, but is not limited to this.

The suction amount $\alpha$ is set to be a value at which no ink leaks from the air communication section 8030 upon ambient temperature fluctuations when the printing apparatus 2 is secondarily transported. That is, the suction amount $\alpha$ is set to be a value at which no ink leaks from the air communication section 8030 even if air in the printhead 7000, supply tube 8001, or ink tank 8020 expands upon ambient temperature fluctuations. The suction amount $\alpha$ is set in consideration of a maximum ink amount in the air communication section 8030. In the embodiment, the transport condition of secondary transport is a condition that the printing apparatus 2 is not greatly tilted.

After the end of the suction draining operation in step S9110, the process advances to step S9120 to set on a secondary transport flag. The secondary transport flag is equivalent to the secondary transport flag in the first embodiment.

After the secondary transport flag is set on, the process advances to step S9130 to automatically turn off the printing apparatus 2, and the pre-transport preparation processing ends. Thereafter, the printing apparatus 2 is transported. At this time, the cap 7010 is positioned at the capping position.

Figure 16:
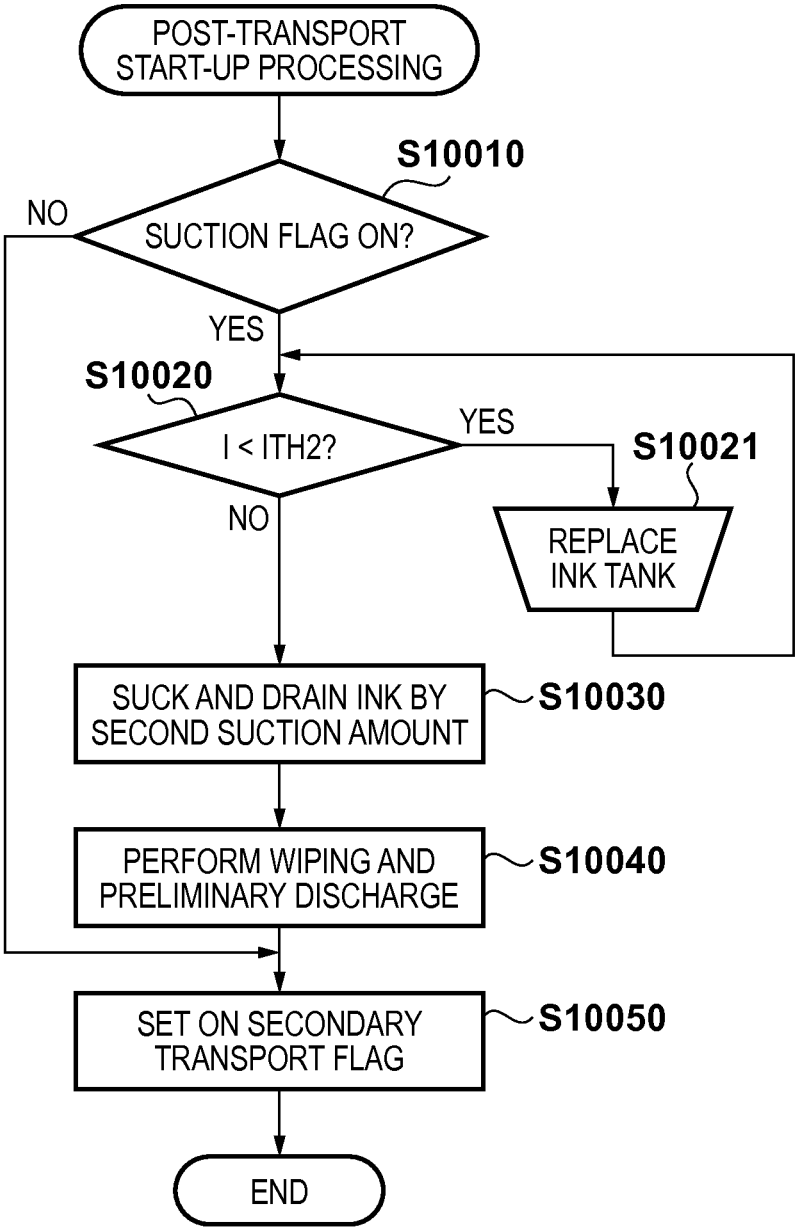
FIG. 16 is a flowchart showing an example of post-transport start-up processing according to the other embodiment.

Next, post-transport processing will be described with reference to FIG. 16. FIG. 16 is a flowchart showing an example of post-transport start-up processing according to the third embodiment. The post-transport start-up processing in FIG. 16 starts when a predetermined transport-preparation condition is satisfied, as in the second embodiment. The third embodiment assumes that the start-up condition is satisfied when the secondary transport flag is ON.

In step S10010, it is determined whether the above-described suction flag is ON. If the determination result in step S10010 is NO, that is, the suction flag is OFF, the secondary transport flag remains OFF (step S10050), and processing of one unit ends.

If the determination result in step S10010 is YES, that is, the suction flag is ON, the process advances to step S10020. Note that the ON state of the suction flag represents the possibility that air enters the supply tube 8001.

In step S10020, the ink remaining amount I of the ink tank 8020 is detected by the sensor 2021 and dot counter, and compared with a preset threshold ITH2. In the embodiment, the concrete value of ITH2 is 15 ml, the reason of which will be described later.

If the determination result in step S10020 is YES, that is, the ink remaining amount I is smaller than the threshold ITH2, the process advances to step S10021 and waits until the ink tank 8020 is replaced. After the ink tank is replaced, the process returns to step S10020.

If the determination result in step S10020 is NO, that is, the ink remaining amount I is equal to or larger than the threshold ITH2, the process advances to step S10030.

In step S10030, ink is sucked and drained from the ink orifice array 7001 by driving the suction pump 1030 in a state in which the cap 7010 is positioned at the capping position. The suction draining amount at this time is a suction amount β. The concrete value is about 14 ml. The suction amount β is an amount for sucking and draining air which may enter the supply tube 8001, that is, an amount for sucking and draining ink in the printhead 7000 and supply tube 8001.

Note that the threshold ITH2 is set to be a value at which air does not enter the supply tube 8001 by the suction draining operation in the suction amount β. By setting the threshold ITH2 to be 15 ml, and the suction amount β to be about 14 ml, entrance of air into the supply tube 8001 can be prevented.

By the suction draining operation in the suction amount β, air which may enter the supply tube 8001 is sucked and drained. At the same time, the insides of the printhead 7000 and supply tube 8001 are filled with ink.

After the end of step S10030, the process advances to step S10040 to perform a known recovery operation including a wiping operation and preliminary discharge operation, and the secondary transport flag is set off (step S10050). Then, post-transport start-up processing of one unit ends.

As described above, according to the third embodiment, when there is the possibility that air enters the supply tube 8001, the suction draining operation in the suction amount β is performed to drain the air. Conversely, when there is not the possibility that air enters the supply tube 8001, the suction draining operation is not performed.

In the above description, the suction draining operation is not performed when the suction flag is OFF. However, the suction draining operation in a suction amount γ may be performed to recover the ink discharge performance. The suction amount γ can be several ml (for example, 1 ml).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2013-177240, filed Aug. 28, 2013, which is hereby incorporated by reference herein in its entirety.

What is claimed is:

1. A printing apparatus comprising:

an ink storage section configured to store ink;

a detection unit configured to detect an ink remaining amount of said ink storage section;

a printhead configured to discharge ink supplied from said ink storage section through an ink passage;

an air communication section configured to communicate with said ink storage section and air;

a suction unit configured to suck ink from said printhead; and a control unit configured to control said suction unit to drain ink from said air communication section through said printhead when a predetermined transport-preparation condition regarding transport of the printing apparatus is satisfied, wherein said control unit is configured to save information about the ink remaining amount detected by said detection unit in a memory in a case that the predetermined transport-preparation condition is satisfied, and wherein said control unit controls said suction unit to suck ink from said printhead based on the information saved in the memory in a case that a predetermined start-up condition is satisfied.

2. The apparatus according to claim 1, wherein the information saved in the memory is information about a result of comparison between the ink remaining amount detected by said detection unit and a threshold, and when the predetermined start-up condition is satisfied, said control unit controls an amount of the ink sucked from said printhead by said suction unit based on the information saved in the memory.

3. The apparatus according to claim 2, wherein in the case that the predetermined start-up condition is satisfied:

when the information saved in the memory represents that the ink remaining amount detected by said detection unit is smaller than the threshold, said control unit is configured to control said suction unit to suck ink of a first ink amount from said printhead, and when the information represents that the ink remaining amount detected by said detection unit is not smaller than the threshold, said control unit is configured to control said suction unit to not suck ink or to suck ink of a second ink amount smaller than the first ink amount from said printhead.

4. The apparatus according to claim 3, wherein the first ink amount is an ink amount by which ink remaining in said printhead and the ink passage can be drained.

5. The apparatus according to claim 3, wherein the second ink amount is several ml.

6. The apparatus according to claim 2, wherein when the predetermined transport-preparation condition is satisfied, said control unit is configured to control said suction unit to suck ink of a predetermined ink amount through said printhead so as to drain ink in said air communication section, and the threshold is an ink amount not smaller than the predetermined ink amount.

7. The apparatus according to claim 6, wherein the predetermined ink amount is set not to leak ink from said air communication section when transporting the printing apparatus.

8. The apparatus according to claim 1, wherein said ink storage section includes an ink tank detachable from the printing apparatus and a sub-tank fixed to the printing apparatus, wherein the sub-tank communicates with the ink tank, wherein the ink passage communicates with the sub-tank, and wherein said air communication section communicates with the ink tank.

9. The apparatus according to claim 8, wherein when the predetermined transport-preparation condition is satisfied, said control unit is configured to compare the ink remaining amount detected by said detection unit with a threshold, and when the ink remaining amount is smaller than the threshold, said control unit is configured to perform processing of prompting a user to select whether to replace the ink tank.

10. The apparatus according to claim 1, wherein when the predetermined transport-preparation condition is satisfied, said control unit controls an amount of the ink sucked from said printhead by said suction unit based on the information saved in the memory.

11. The apparatus according to claim 10, wherein in the case that the predetermined transport-preparation condition is satisfied, when the information represents that the ink remaining amount detected by said detection unit is not smaller than the threshold, said control unit is configured to control said suction unit to suck ink of a first ink amount from said printhead, and when the information represents that the ink remaining amount detected by said detection unit is smaller than the threshold, said control unit is configured to control said suction unit to suck ink of a second ink amount larger than the first ink amount from said printhead.

12. The apparatus according to claim 10, wherein said ink storage section includes an ink tank detachable from the printing apparatus and a sub-tank fixed to the printing apparatus, wherein the sub-tank communicates with the ink tank, wherein the ink passage communicates with the sub-tank, wherein said air communication section communicates with the ink tank, wherein when the predetermined transport-preparation condition is satisfied, said control unit is configured to control said suction unit to suck ink of a first ink amount, and wherein when the information represents that the ink remaining amount detected by said detection unit is smaller than the threshold, said control unit is configured to control said suction unit to further suck ink of a second ink amount after the ink tank is detached.

13. The apparatus according to claim 12, wherein the second ink amount is an ink amount by which ink remaining in said printhead, the ink passage, and the sub-tank can be drained.

14. The apparatus according to claim 1, wherein said ink storage section includes an ink tank detachable from the printing apparatus and a sub-tank fixed to the printing apparatus, wherein the sub-tank communicates with the ink tank, wherein the ink passage communicates with the sub-tank, wherein said air communication section communicates with the ink tank, wherein said detection unit includes a sensor arranged in the ink tank, a sensor arranged in the sub-tank, and a counter configured to count an amount of ink drained from said printhead, and wherein the ink remaining amount is a sum of an ink remaining amount of the ink tank and an ink remaining amount of the sub-tank.

15. The apparatus according to claim 1, wherein said ink storage section includes an ink tank detachable from the printing apparatus and a sub-tank fixed to the printing apparatus, wherein the sub-tank communicates with the ink tank, wherein the ink passage communicates with the sub-tank, wherein said air communication section communicates with the ink tank, and wherein the printing apparatus further comprises a charging unit configured to move ink in the ink tank to the sub-tank.

16. The apparatus according to claim 1, wherein said ink storage section includes an ink tank detachable from the printing apparatus and a sub-tank fixed to the printing apparatus, wherein the sub-tank communicates with the ink tank, wherein the ink passage communicates with the sub-tank, wherein said air communication section communicates with the ink tank, and wherein the ink tank is separable from the printing apparatus when the apparatus is being transported.

17. The apparatus according to claim 1, further comprising an opening/closing valve configured to open/close the ink passage, wherein said opening/closing valve is set to a closed state when the apparatus is being transported.

18. The apparatus according to claim 1, further comprising a maintenance cartridge detachable from the printing apparatus and configured to accommodate ink sucked by said suction unit.

19. A printing apparatus comprising:

a plurality of ink storage sections arranged for respective ink types and configured to store ink;

a detection unit configured to individually detect ink remaining amounts of said ink storage sections;

a printhead including a plurality of ink orifices for each ink type, and configured to discharge inks supplied from said respective ink storage sections through ink passages of the respective ink types;

a plurality of air communication sections arranged for said respective ink storage sections and configured to communicate with said corresponding ink storage sections and air;

a suction unit configured to suck ink from said printhead for each group of the ink orifices; and a control unit configured to control said suction unit to drain ink from said air communication section through said printhead when a predetermined transport-preparation condition regarding transport of the printing apparatus is satisfied, wherein said control unit is configured to save information about the ink remaining amounts detected by said detection unit in a memory in a case that the predetermined transport-preparation condition is satisfied, and said control unit controls said suction unit to suck ink from the ink orifices for each group based on the information saved in the memory in a case that a predetermined start-up condition is satisfied.

20. The apparatus according to claim 19, wherein the information is information for each group, and is information about a comparison result representing a predetermined relationship, among results of comparison between the ink remaining amounts of said respective ink storage sections detected by said detection unit, and a threshold.

21. The apparatus according to claim 20, wherein the threshold is set for each ink type in accordance with the number of ink orifices of the ink type.

22. The apparatus according to claim 19, wherein each of said ink storage sections includes an ink tank detachable from the printing apparatus and a sub-tank fixed to the printing apparatus, wherein each of the sub-tanks communicates with the respective ink tank, wherein each of the ink passages communicates with the respective sub-tank, wherein each of said air communication sections communicates with the respective ink tank, wherein said detection unit includes a sensor arranged in each of the ink tanks, a sensor arranged in each of the sub-tanks, and a counter configured to count an amount of ink drained from said printhead, and wherein each of the ink remaining amounts is a sum of an ink remaining amount of the respective ink tank and an ink remaining amount of the respective sub-tank.

23. The apparatus according to claim 19, wherein each of said ink storage sections includes an ink tank detachable from the printing apparatus and a sub-tank fixed to the printing apparatus, wherein each of the sub-tanks communicates with the respective ink tank, wherein each of the ink passages communicates with the respective sub-tank, wherein each of said air communication sections communicates with the respective ink tank, and wherein the printing apparatus further comprises a charging unit configured to move ink in each of the ink tanks to the respective sub-tank.

24. The apparatus according to claim 19, wherein each of said ink storage sections includes an ink tank detachable from the printing apparatus and a sub-tank fixed to the printing apparatus, wherein each of the sub-tanks communicates with the respective ink tank, wherein each of the ink passages communicates with the respective sub-tank, wherein each of said air communication sections communicates with the respective ink tank, and wherein the ink tanks are separable from the printing apparatus when the apparatus is being transported.

25. The apparatus according to claim 19, further comprising opening/closing valves configured to open/close the ink passages, wherein said opening/closing valves are set to a closed state when the apparatus is being transported.

26. The apparatus according to claim 19, further comprising a maintenance cartridge detachable from the printing apparatus and configured to accommodate ink sucked by said suction unit.

27. A method of controlling a printing apparatus including:

an ink storage section configured to store ink;

a printhead configured to discharge ink supplied from the ink storage section through an ink passage;

an air communication section configured to communicate with the ink storage section and air; and a suction unit configured to suck ink from the printhead, the method comprising the steps of:

before transporting the printing apparatus, saving information about an ink remaining amount of the ink storage section, and controlling the suction unit to drain ink in the air communication section through the printhead; and after transporting the printing apparatus, controlling, based on the information, the suction unit to suck ink from the printhead.

28. A printing apparatus comprising:

an ink storage section configured to store ink;

a detection unit configured to detect an ink remaining amount of said ink storage section;

a printhead configured to discharge ink supplied from said ink storage section;

an air communication section through which said storage section communicates with air;

a suction unit having a cap and configured to suck ink from said printhead through the cap; and a control unit configured to perform a preparation process before transport of the apparatus according to an instruction regarding transport of the apparatus and to perform a start-up process when the apparatus is started up after the transport of the apparatus, wherein the preparation process includes:

a detecting process of detecting the ink remaining amount by said detection unit;

a saving process of saving information regarding the ink remaining amount detected in the detecting process; and a first suction process in which said suction unit sucks ink in said air communication section from said printhead, wherein the start-up process includes a second suction process in which said suction unit sucks ink from said printhead based on the information saved in the saving process.

29. The apparatus according to claim 28, further comprising a memory unit to save the information in the saving process, the control unit controls said suction unit based on the information read from the memory unit in the second suction process.

30. The apparatus according to claim 29, wherein in a case that the information represents that the ink remaining amount detected by said detection unit is not smaller than a threshold, said control unit controls said suction unit to suck ink of a first ink amount from said printhead in the second suction process, and in a case that the information represents that the ink remaining amount detected by said detection unit is smaller than the threshold, said second control unit controls said suction unit to suck ink of a second ink amount larger than the first ink amount from said printhead in the second suction process.

31. The apparatus according to claim 30, wherein the first ink amount is an ink amount by which ink remaining in said printhead and an ink passage can be drained, and said ink storage section communicates with said printhead through the ink passage.

32. The apparatus according to claim 30, wherein in the first suction process, said control unit controls said suction unit to suck ink of a predetermined ink amount through said printhead so as to drain ink from said air communication section, and wherein the threshold is an ink amount not smaller than the predetermined ink amount.

33. The apparatus according to claim 28, wherein said ink storage section includes an ink tank detachable from the printing apparatus and a sub-tank fixed to the printing apparatus, wherein the sub-tank communicates with the ink tank, wherein the sub-tank communicates with the printhead through an ink passage, and wherein said air communication section communicates with the ink tank.

34. The apparatus according to claim 33, wherein the ink remaining amount is a sum of an ink remaining amount of the ink tank and an ink remaining amount of the sub-tank.

* * * * *